US010950084B2

(12) United States Patent
Watkeys

(10) Patent No.: US 10,950,084 B2
(45) Date of Patent: Mar. 16, 2021

(54) WAGERING SYSTEM WITH A TRIGGER SYMBOL AND PLAYER ADJUSTABLE LAYOUT AND SYMBOL GROUP SIZE

(71) Applicant: Pridefield Limited, Douglas (IM)

(72) Inventor: Thomas William Watkeys, Westville (ZA)

(73) Assignee: FUSION HOLDINGS LIMITED, Douglas (IM)

( * ) Notice: Subject to any disclaimer, the term of this patent is extended or adjusted under 35 U.S.C. 154(b) by 0 days.

(21) Appl. No.: 16/268,212

(22) Filed: Feb. 5, 2019

(65) Prior Publication Data

US 2019/0259240 A1 Aug. 22, 2019

(30) Foreign Application Priority Data

Feb. 20, 2018 (GB) ..... 1802731

(51) Int. Cl.
*G07F 17/32* (2006.01)

(52) U.S. Cl.
CPC ..... *G07F 17/3213* (2013.01); *G07F 17/3209* (2013.01); *G07F 17/3244* (2013.01); *G07F 17/3288* (2013.01)

(58) Field of Classification Search
CPC ..... G07F 17/3213; G07F 17/3209; G07F 17/3244; G07F 17/3288
See application file for complete search history.

(56) References Cited

U.S. PATENT DOCUMENTS 4,747,600 A * 5/1988 Richardson ..... A63F 3/0645 273/139
6,012,720 A * 1/2000 Webb ..... A63F 3/00157 273/292
6,443,455 B1 * 9/2002 Webb ..... A63F 3/00157 273/274
6,554,702 B2 * 4/2003 Mahar ..... A63F 1/00 273/292
7,704,141 B1 * 4/2010 Marks ..... G07F 17/34 463/20
9,324,214 B2 * 4/2016 Aoki ..... G07F 17/3211
2007/0035091 A1 * 2/2007 Tang ..... A63F 3/00157 273/292
2008/0252013 A1 * 10/2008 Tang ..... A63F 3/00157 273/292

(Continued)

*Primary Examiner* — Omkar A Deodhar
*Assistant Examiner* — Matthew D Hoel
(74) *Attorney, Agent, or Firm* — McDonnell Boehnen Hulbert & Berghoff LLP

(57) ABSTRACT

Apparatus and methods for playing a game are presented. A computing device can select a set of symbols that include non-blank symbols and blank symbols, where a number of non-blank symbols is greater than zero, and a number of the blank symbols is greater than zero. The computing device can provide a display comprising a grid of the set of symbols. The computing device can play a turn of a game using the computing device by at least: after providing the display, receiving a wager; after receiving the wager, selecting one or more winning symbols of the first set of symbols; after selecting the winning symbols, updating the display to indicate each winning symbol within the grid; determining a payout of the wager based on the winning symbols and the number of first blank symbols; and updating the display based on the payout of the wager.

18 Claims, 16 Drawing Sheets

(56) References Cited

U.S. PATENT DOCUMENTS

| | | | | |
|---|---|---|---|---|
| 2014/0066170 | A1* | 3/2014 | Aoki | G07F 17/3211 463/20 |
| 2015/0325078 | A1* | 11/2015 | Alsip | G07F 17/326 463/17 |
| 2015/0325079 | A1* | 11/2015 | Alsip | G07F 17/323 463/20 |

* cited by examiner

Pay Table 500

| Symbol 502 | Payout 504 |
|---|---|
| Sym1 | Pay1 |
| Sym2 | Pay2 |
| ... | |
| Sym_Nsym | Pay_Nsym |

Blank Multiplier Table (BM) 510

| NB 512 | BM 514 |
|---|---|
| x for $1 \le x \le (GC-1)$, where GC = NR*NC | $\text{int}\left[\frac{GC}{(GC - x)}\right]$ |

Actual Payout for Sym1 with y blanks:
$APay = Pay1^* BM(y),\ 1 \le y \le (GC-1)$ Pay Tables 520

Pay Table for NB = 1 520a

| Symbol 522a | Payout 524a |
|---|---|
| Sym1 | Pay1_1 |
| Sym2 | Pay2_1 |
| ... | |
| Sym_Nsym | Pay_Nsym_1 |

Pay Table for NB = 2 520b

| Symbol 522b | Payout 524b |
|---|---|
| Sym1 | Pay1_2 |
| Sym2 | Pay2_2 |
| ... | |
| Sym_Nsym | Pay_Nsym_2 |

...

Pay Table for NB = GC-1 520c

| Symbol 522c | Payout 524c |
|---|---|
| Sym1 | Pay1_GC-1 |
| Sym2 | Pay2_GC-1 |
| ... | |
| Sym_Nsym | Pay_Nsym_GC-1 |

Pay Table 530

| Symbol 532 | NB 534 | Payout 536 |
|---|---|---|
| Sym1 | 1 | Pay1_1 |
| Sym1 | 2 | Pay1_2 |
| ... | | |
| Sym1 | GC-1 | Pay1_GC-1 |
| Sym2 | 1 | Pay2_1 |
| Sym2 | 2 | Pay2_2 |
| ... | | |
| Sym_Nsym | Pay_Nsym_GC-1 | Pay_Nsym_GC-1 |

FIG. 5

1600

1610 Select a first set of symbols using a computing device, the first set of symbols including first non-blank symbols and first blank symbols, where a number of the first non-blank symbols is greater than zero, and a number of the first blank symbols in the first set of symbols is greater than zero

↓

1620 Provide a display including a grid of the first set of symbols using the computing device

↓

1630 Play a first turn of a game using the computing device, the first turn including:

- After providing the display, receive a wager
- After receiving the wager, select one or more winning symbols of the first set of symbols
- After selecting the one or more winning symbols, update the display to indicate each of the one or more winning symbols within the grid
- Determine a payout of the wager based on the one or more winning symbols and the number of first blank symbols and
- Update the display based on the payout of the wager

FIG. 16

WAGERING SYSTEM WITH A TRIGGER SYMBOL AND PLAYER ADJUSTABLE LAYOUT AND SYMBOL GROUP SIZE

CROSS-REFERENCE TO RELATED APPLICATIONS

This application claims priority under 35 U.S.C. § 119 to United Kingdom Patent Application No. 1802731.8 filed on Feb. 20, 2018. United Kingdom Patent Application No. 1802731.8 is hereby incorporated by reference in its entirety for all purposes.

BACKGROUND

Wager games come in a variety of forms, including for example a mechanical slot machine. A mechanical slot machine may include one or more reels, each of which includes a fixed pattern of symbols distributed around the circumference of the reel. When a player places a wager (e.g., by placing a coin in the machine), the player is allowed to spin the reels. Each reel then comes to rest, typically with either one of the symbols, or a space in between symbols, in alignment with a pay line. A predefined winning symbol or a predefined combination of winning symbols that are aligned with the pay line can result in the player winning the game and receiving a payout. In one example, the machine may include three reels, and the pay line may be a horizontal line disposed across a centre of each of the three reels.

In another example of a wager game, a mechanical slot machine may present symbols in a grid arrangement, with each symbol changing during a spin of the game according to the fixed pattern of symbols on the reels. For example, the machine may have five columns and three rows of symbols, for a total of fifteen symbols. Such machines often have multiple pay lines, each being defined by a collection of positions within the grid. For instance, the machine may have three pay lines, each corresponding to one row of the grid.

Overview

In a first aspect, a method is provided. A computing device selects a first set of symbols. The first set of symbols includes first non-blank symbols and first blank symbols, where a number of the first non-blank symbols in the first set of symbols is greater than zero, and a number of the first blank symbols in the first set of symbols is greater than zero. The computing device provides a display including a grid of the first set of symbols. The computing device is used to play a first turn of a game. The first turn includes: after providing the display, receiving a wager; after receiving the wager, selecting one or more winning symbols of the first set of symbols; after selecting the one or more winning symbols, updating the display to indicate each of the one or more winning symbols within the grid; determining a payout of the wager based on the one or more winning symbols and the number of first blank symbols; and updating the display based on the payout of the wager.

In a second aspect, a computing device is provided. The computing device includes one or more processors; and data storage configured to store at least computer-readable program instructions that, when executed by the one or more processors, cause the computing device to carry out functions. The functions include: selecting a first set of symbols, the first set of symbols including first non-blank symbols and first blank symbols, where a number of the first non-blank symbols in the first set of symbols is greater than zero, and a number of the first blank symbols in the first set of symbols is greater than zero; providing a display including a grid of the first set of symbols; and playing a first turn of a game, the first turn including: after providing the display, receiving a wager; after receiving the wager, selecting one or more winning symbols of the first set of symbols; after selecting the one or more winning symbols, updating the display to indicate each of the one or more winning symbols within the grid; determining a payout of the wager based on the one or more winning symbols and the number of first blank symbols; and updating the display based on the payout of the wager.

In a third aspect, a computer-readable medium is provided. The computer-readable medium is configured to store instructions that, when executed by one or more processors of a computing device, cause the computing device to carry out functions. The functions include: selecting a first set of symbols, the first set of symbols including first non-blank symbols and first blank symbols, where a number of the first non-blank symbols in the first set of symbols is greater than zero, and a number of the first blank symbols in the first set of symbols is greater than zero; providing a display including a grid of the first set of symbols; and playing a first turn of a game, the first turn including: after providing the display, receiving a wager; after receiving the wager, selecting one or more winning symbols of the first set of symbols; after selecting the one or more winning symbols, updating the display to indicate each of the one or more winning symbols within the grid; determining a payout of the wager based on the one or more winning symbols and the number of first blank symbols; and updating the display based on the payout of the wager.

In a fourth aspect, the disclosure provides a computing device. The computing device includes: means for selecting a first set of symbols, the first set of symbols including first non-blank symbols and first blank symbols, where a number of the first non-blank symbols in the first set of symbols is greater than zero, and a number of the first blank symbols in the first set of symbols is greater than zero; means for providing a display including a grid of the first set of symbols; and means for playing a first turn of a game, the first turn including: after providing the display, receiving a wager; after receiving the wager, selecting one or more winning symbols of the first set of symbols; after selecting the one or more winning symbols, updating the display to indicate each of the one or more winning symbols within the grid; determining a payout of the wager based on the one or more winning symbols and the number of first blank symbols; and updating the display based on the payout of the wager.

BRIEF DESCRIPTION OF THE FIGURES

FIG. 5 depicts example pay tables for use by a computing device, in accordance with example embodiments.

FIG. 16 is a flow chart of functions to carry out a method, in accordance with example embodiments.

DETAILED DESCRIPTION

I. Introduction

Figure 1:
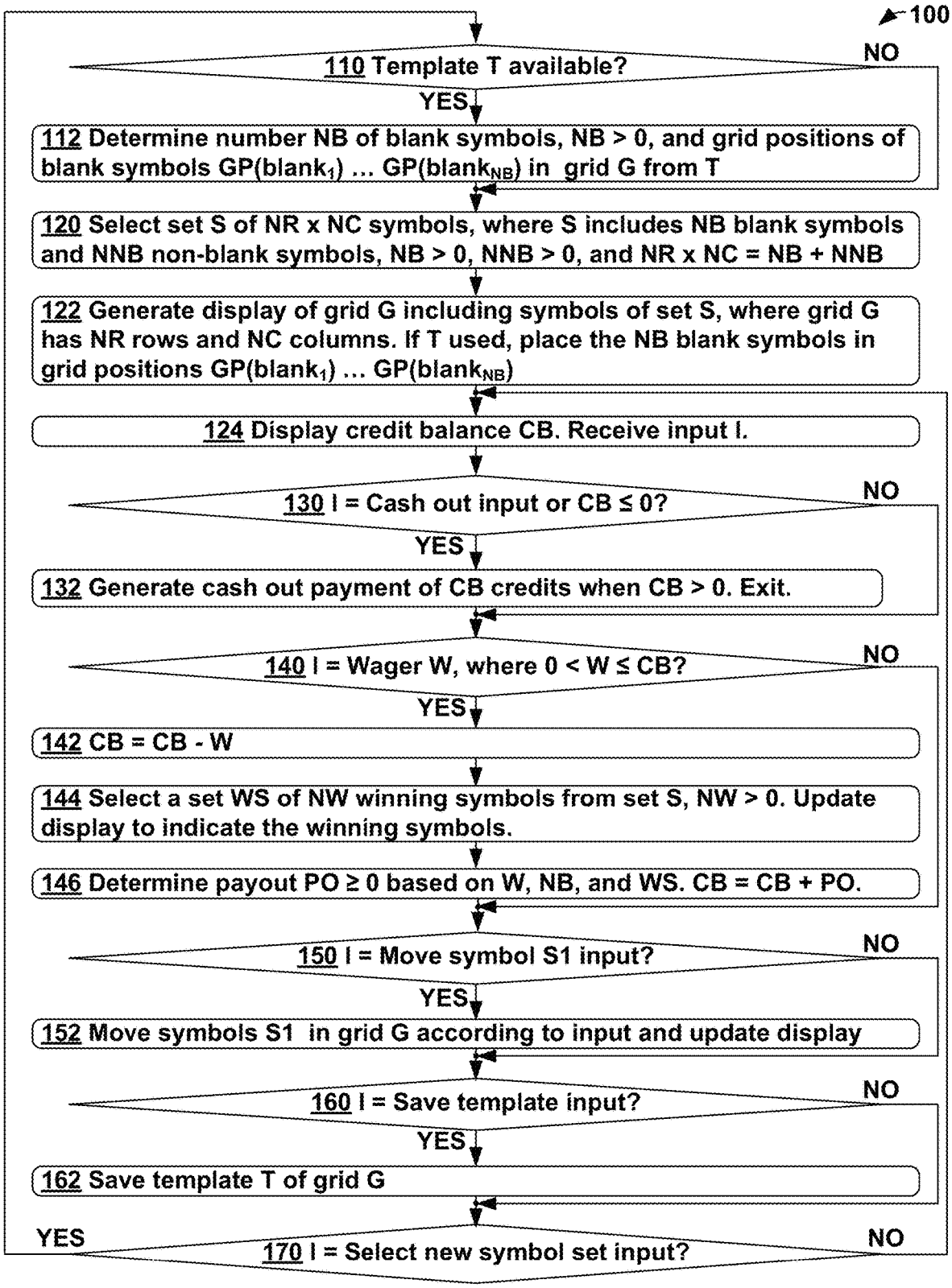
FIG. 1 is a flow chart illustrating a set of functions that can be carried out by a gaming device, in accordance with example embodiments.

While slot machines were traditionally mechanical, modern slot machines often take the form of a computing device acting as a video gaming device (e.g., a dedicated gaming machine located in a casino, a computing device executing a software application that enables game play). The video gaming device, or gaming device for short, can include a graphical user interface (GUI) that can be used to provide game-related displays, such as displays of a game involving a grid of symbols.

Herein is described a new type of wagering game that can be played using a gaming device. The game has the following characteristics: a symbol set; a grid of symbol positions; and one or more pay tables. A turn of the game can begin with the gaming device populating the grid with randomly-selected symbols from the symbol set, where the number of randomly-selected symbols is less than the number of symbol positions in the grid (i.e., some of the symbol positions in the grid are blank).

The gaming device can randomly (or otherwise) populate or select symbols in the grid. The grid of symbols can include blank symbols and non-blank symbols. In some examples, the number of blank symbols NB in the grid can be fixed; while in other examples, NB can be randomly determined as well, perhaps as a number of blank of symbols within a range of numbers of blank symbols.

Once the grid is populated, the gaming device can randomly select NW winning symbol positions from the grid (e.g., NW is a predetermined or randomly chosen integer in the range of 1-10). The set of symbols in the NW winning symbol positions are compared to a pay table and winning symbol combinations are paid out. For example, in a grid having 36 symbols in which a number NW=3 of winning symbols is selected, NB can be selected between 4 and 18 and the remaining 36−NB non-blank symbols can be selected for the grid. Then, NW winning symbols can be selected in each turn of the game. In this example, the lower bound of four on NB was determined as NW+1 and the upper bound on NB of eighteen was determined as ½ of the 36 number of symbols in the grid. Other lower and/or upper bounds on NB are possible as well.

Beginning the game can include providing cash, coins, and/or other payment (e.g., printed tickets, tokens, electronic payment, initialized with free credits in a prototype system or demonstration mode) to the gaming device to establish an initial credit balance to play the game. In some examples, the game can be implemented as a software application of the gaming device; then, to begin the game, the gaming device can execute the software application and establish an initial credit balance; e.g., using the software application.

Once the game has begun, the gaming device can play the game for one or more turns. In some examples, the gaming device can be used to play a turn of the game by: (1) populating and displaying the grid of symbols, (2) receiving a wager; e.g., from the credit balance, (2) selecting the NW winning positions within the grid, (3) updating the display to show the NW winning positions within the grid, (4) determining which symbol(s) are located in the NW winning position(s) of the grid, (5) determining a payout based on at least the wager and the determined symbol(s), and (6) updating the display based on the payout. The payout could be made electronically; e.g., the payout could be added to a credit balance. Alternatively, the payout could be provided as one or more coins and/or printed tickets. In some examples, each subsequent turn of the game can involve only steps (2)-(6) above. Thus, the grid displayed in step (1) could be displayed persistently throughout game play.

The game can continue until the player cashes out. In examples, the player could cash out by providing an input to the gaming device requesting cash, coin, and/or other payment of game credits which implicitly ends the game or by providing an input to the gaming device to end the game. In some cases, the game may continue until the player's credit balance is insufficient for wagering. However, the player may also be able to add credits to the credit balance to continue play.

The symbol set, and thus the displayed grid of symbols, can include one or more blank symbols and one or more non-blank symbols. The non-blank symbols can include, but are not limited to, images and/or symbols such as might be seen on a reel of a slot machine, computer icons, paintings, letters, numbers, gambling-related imagery (e.g., images of playing cards, casino chips, dice) words, phrases, and/or other non-blank symbols. One or more of the non-blank symbols can be animated and/or have related audio; e.g., a particular song or other audio can be played when a particular symbol is selected as winning symbol, a (short) animation of a symbol can be played periodically or at random intervals of time.

A pay table, or in some cases, pay tables, can be used for determining a payout of a wager. The pay table(s) can be based on the wager, the NW winning symbols, and perhaps based on the number of blank symbols NB. In some cases, the gaming device can have a plurality of pay tables each associating payouts with symbols. As an example, a pay table may specify a base payout of 1 credit for symbol "A", a base payout of 3 credits for symbol "123", etc. The base payout can be multiplied or otherwise scaled by the wager (e.g., a wager of 2 credits can be used as a multiplier for a base payout of 3 credits for symbol "123" for a total payout of 2×3=6 credits).

In some examples, the pay tables can depend on the number of blank symbols NB. In some of these examples, a plurality of pay tables can be used by the gaming device. The plurality of pay tables can include a first pay table associated with a first particular number of blank symbols and a second pay table associated with a second particular number of blank symbols that is greater than the first particular number of blank symbols, and the second pay table can have a larger average payout of than the first pay table. In this way, the gaming device can use pay tables that provide larger payouts as the number of blank symbols increase, to account for different grids with different numbers of blank symbols. Thus, a payout of the game can be based on the wager, the determined symbol(s), and the number of blank symbols. Other techniques for determining payouts of a wager based on wagers, NW winning symbols, and/or a number of blank symbols are possible as well.

The game can include a bonus feature related to a trigger symbol of the set of symbols. As an example, the bonus feature can be initiated or "triggered" when the NW winning symbols include one or more trigger symbols, resulting in the NW winning symbols being augmented by x additional symbols randomly selected from the symbol set (e.g., x is a predetermined or randomly chosen integer in the range of 1-10). The resulting augmented set of NW+x selected symbols is compared to one or more pay tables and any winning symbol combinations are paid out. With such a bonus feature, a payout of the game can be based on the wager, the determined symbol(s) including any additional symbols added in response to receiving the trigger symbol, and the number of blank symbols. In some examples, the payout is not directly associated with the trigger symbol; rather, the payout of the trigger symbol is determined as the sum of payouts of the additional symbols triggered by a winning trigger symbol. In other examples, the trigger symbol can have its own payout and any additional symbols triggered by the winning trigger symbol can provide additional payouts.

In some examples, a player of the game is allowed to make some modifications to the grid of symbols. For instance, a player of the game can rearrange the layout of any, or all, of the randomly-selected symbols that populate the grid. A player can rearrange symbols by swapping a selected non-blank symbol and a blank symbol by using the gaming device for dragging-and-dropping (or a similar user interface technique) the selected non-blank symbol onto a grid position of the blank symbol. After the selected non-blank symbol is dropped, the gaming device can place a blank symbol in a grid position previously occupied by the selected non-blank symbol, thereby swapping the selected non-blank symbol and the blank symbol. Other techniques for moving and/or changing blank and/or non-blank symbols in the grid are possible as well.

As another example of player modification to the grid of symbols, the gaming device can provide a user interface control that, when selected, causes the gaming device to select a new set symbols for the grid of symbols and replace a currently-displayed set of symbols in the grid of symbols with the new set of symbols. By selecting new sets of symbols, the player can (indirectly) select the number of randomly-selected symbols to populate the grid (thus allowing the player to adjust the volatility of the game). A grid with more blank symbols (and thus, fewer non-blank symbols) reduces the probability of a winning symbol combination, but such a winning combination may correspond to a higher payout according to the pay tables. For instance, blank symbols (and perhaps some non-blank symbols) in the grid can be associated with a zero payout, and the odds of winning a payout can be based on a number of blank symbols NB within the grid of symbols.

In some examples, the new set of symbols has a different number of blank symbols than the currently-displayed set of symbols. In other examples, the new set of symbols has the same number of blank symbols than the currently-displayed set of symbols. In some examples, the same number of blank symbols can be randomly selected for both the new set of symbols and the currently-displayed set of symbols. In other examples, the same number of blank symbols can be used for all selections of sets of symbols.

In some cases, the player can generate and save a layout of the grid as a template for later use in populating the grid. For instance, a player can decide that a particular configuration of blank and non-blank symbols of a displayed grid of symbols is appealing and save the displayed grid as a template. The template can store locations of blank and/or non-blank symbols in the grid. Then, when the gaming device next selects a grid of symbols, the gaming device can select symbols according to the saved template.

For example, a template of a 5×5 grid of symbols with NB=5 can have four blank symbols in the corners and a blank symbol in the middle position of the 5×5 grid. Later, the gaming device can select blank symbols for the corners and a middle square of the 5×5 grid in accord with the template and randomly or otherwise select the remaining 20 non-blank symbols of the 5×5 grid. After selecting the symbols in accord with the template, the gaming device can then display the 5×5 grid of selected symbols and perhaps play turns of the game using the displayed grid of symbols. Many other examples of templates are possible as well.

The herein-described wagering game can provide aspects of reel-based games and card-based games. Like a reel-based game, winning symbols are selected from among a potentially wide range of symbols. Like a card-based game, the grid of symbols can be reselected in a similar way that cards are reshuffled. Aspects of the grid of symbols can be chosen by the player, such as the number and locations of blank symbols and (re)selection events for the grid of symbols, thereby adding to perceived player choice and enhancing player satisfaction. The game can also result in a high degree of player acceptance by being easy to learn and play. Further, the provision of a trigger symbol to generate additional symbols for bonus payments can beneficially increase player play times. For example, a player may be motivated to keep playing until the trigger symbol is selected as a winning symbol.

II. Example Wagering System Methods

FIG. 1 is a flow chart depicting a set of functions 100 that can be carried out by a gaming device, in accordance with example embodiments. For example, software and/or hardware of a computing device, such as computing device 200 described below, can be executed by the computing device to act as a gaming device and to carry out some or all the set of functions 100. The set of functions 100 can be performed by the gaming device to enable a player to play a wagering game based on a grid of symbols. The set of functions are shown within blocks 110 through 170. A description of those blocks now follows.

At block 110, the gaming device can start set of functions 100 by determining whether a template T of a grid of symbols is available. The template T can specify locations of blank symbols in the grid of symbols, and thereby, template T can (implicitly) specify a number of blank symbols NB. If the template T is available, the gaming device can proceed to block 112. Otherwise, the template T is unavailable and the gaming device can proceed to block 120.

At block 112, the gaming device can determine the number NB of blank symbols and grid positions of blank symbols $GP(blank_1) \ldots GP(blank_{NB})$ in grid G from T. For example, template T can be a list or similar data structure indicating one or more locations GP of blank symbols in grid G. As a particular example, let grid G be a 5×5 grid and let template T specify that each corner of grid G and the center grid location of grid G are blank symbols. Then, template T can be a list having five grid locations for grid G: (1, 1) for the upper left corner grid location, (1, 5) for the upper right corner grid location, (3, 3) for the center grid location, (5, 1) for the lower left grid location, and (5, 5) for the lower right grid location. Using the nomenclature above for this example, template T can list NB=5 blank symbol locations as $GP(blank_1)=(1, 1)$, $GP(blank_2)=(1, 5)$, $GP(blank_3)=(3, 3)$, $GP(blank_4)=(5, 1)$, $GP(blank_5)=(5, 5)$. In other examples, different orderings of grid locations, indexing schemes (e.g., grid locations can be specified using zero based indexing rather than one based indexing used in this example), grid examples, numbers and locations blank symbols can be used. In some cases, template T can store the value of the number of blank symbols NB, a size of grid G, and/or other data about grid G as well.

At block 120, the gaming device can select a set S of symbols of size NR×NC. In this example, grid G is a two-dimensional grid having NR rows and NC columns, where NR and NC are both greater than zero. The gaming device can select NB blank symbols and NNB non-blank symbols for set S, where both NB and NNB are greater than zero, and where NR×NC=NB+NNB. For example, let grid G have four rows and nine columns; i.e., NR=4 and NC=9. Then, set S has 4×9=36 symbols. Further, let the gaming device select six blank symbols and 30 non-blank symbols for set S; then, NB=6, NNB=30, and NB+NNB=6+30=36=4×9=NR×NC.

In some examples, NB can be determined based on template T discussed above in the context of block 112; then, the gaming device can select the remaining number of non-blank symbols NNB=NR×NC−NB non-blank symbols for set S. In other examples, NB can be determined randomly. In such examples, NB can be selected randomly within a range of values. For instance, NB can be selected as a value in the range [1, (NR×NC)/2] to ensure that there is at least one blank value and that at least half of the NR×NC symbols in S are non-blank symbols. In other examples, NB can be a predetermined value; e.g., a predetermined value between 1 and 10. In still other examples, NB can be based on a size of the grid, such as NB=⅓(NR×NC).

Once NB is determined, the number of non-blank symbols NNB can be determined as NNB=NR×NC−NB and the gaming device can randomly or otherwise choose the NNB non-blank symbols. Alternatively, the number of non-blank symbols NNB and/or the non-blank symbols can be predetermined. For example, NNB can be a predetermined value and the non-blank symbols can be specified by a predetermined list (or similar data structure) of non-blank symbols.

The non-blank symbols can include, but are not limited to, images and/or symbols such as might be seen on a reel of a slot machine, computer icons, paintings, letters, numbers, gambling-related imagery (e.g., images of playing cards, casino chips, dice) words, phrases, and/or other non-blank symbols. One or more of the non-blank symbols can be animated and/or have related audio. For example, a particular song or other audio can be played when a particular symbol is selected as a winning symbol and/or an animation of a symbol can be played periodically or at random intervals of time. Other techniques for determining set S, blank symbols, non-blank symbols, NC, NR, NB, and/or NNB are possible as well.

At block 122, the gaming device can generate a display of grid G including symbols of set S, where grid G has NR rows and NC columns. If template T used, the gaming device can place the NB blank symbols in grid positions $GP(blank_1) \ldots GP(blank_{NB})$. In some examples, set S can be stored as a matrix or grid of symbols, in these examples, grid G and set S may be stored using a same or common data structure; e.g., grid G and set S can be stored and/or implemented as a NR×NC matrix of symbols.

At block 124, the gaming device can display a credit balance CB for a player. For example, a display to display grid G, such as generated at block 122, can also display credit balance CB. In another example, a display to display grid G can be updated to display a most recent value of credit balance CB. Also at block 124, the gaming device can receive an input I related to the game; e.g., the player can provide input I using a user interface of the gaming device. In some cases, the gaming device can wait at block 124 until input I is received.

At block 130, the gaming device can determine whether input I is a cash out input and/or whether the credit balance CB≤0. If input I is a cash out input or the credit balance CB≤0, then the gaming device can proceed to block 132. Otherwise, the gaming device can determine that input I is not a cash out input and the credit balance CB>0, and the gaming device can proceed to block 140.

At block 132, the gaming device can generate a cash out payment of CB credits when CB>0. The cash out payment can be generated using coins, cash, tokens, printed tickets, electronic payments, and/or other payment articles. If CB≤0, then no cash out payment is generated. After generating the cash out payment, if any, the gaming device can exit, thereby ceasing performance of set of functions 100.

In some examples when CB≤0, the gaming device can request additional credits be provided to continue playing rather than exiting at block 132. If the player does provide additional credits, the additional credits can be added to the credit balance CB and the gaming device can proceed to block 124. Otherwise, the player does not provide additional credits, and the gaming device can exit and cease performance of set of functions 100.

At block 140, the gaming device can determine whether input I is an input corresponding to a wager of W credits, where 0<W≤CB. If the gaming device determines that input I is an input corresponding to a wager, then the gaming device can proceed to block 142. Otherwise, the gaming device can determine that input I does not correspond to a wager and can proceed to block 150.

After determining at block 140 that input I corresponds to a wager of W credits, the gaming device can carry out the procedures of blocks 142, 144, and 146 to play a turn of the game. At block 142, the gaming device can deduct wager W from credit balance CB; e.g., calculate CB=CB−W.

At block 144, the gaming device can select a set WS of NW winning symbols from set S, where NW>0. For example, let NW=3, then set WS is a set of 3 (NW) winning symbols in set S, where each symbol in set WS can be a blank symbol or a non-blank symbol. Also, the gaming device can determine a corresponding grid positions in grid G for each symbol in WS at block 144 as well. The gaming device can also update the display of grid G to indicate a grid location in grid G of each winning symbol in WS.

In some examples, the set S can include one or more trigger symbols. If a trigger symbol is selected as a symbol in set WS, a bonus feature can be activated. The bonus feature can involve adding one or more additional symbols to set WS. Thus, if a trigger symbol is selected as a winning symbol, additional winning symbols can added to set WS. In such examples, the gaming device can animate the additional symbols and/or provide an animation related to the additional symbols. In some implementations, the animations can be provided with associated sound effects. The animations and sound effects can beneficially increase player excitement and enjoyment when a trigger symbol is selected as a winning symbol, thereby increasing player interest in the herein-described game.

At block 146, the gaming device can determine a payout value PO=0 based on wager W, the number of non-blanks NB, and the set of winning symbols WS. In some examples, the gaming device can use one or more pay tables to determine PO. Example pay tables are discussed in the context of FIG. 5. If each symbol in set WS is associated with a zero payout, then the gaming device can determine that PO=0. Otherwise, if at least one symbol in set WS is associated with a non-zero payout, then the gaming device can determine PO based on W and the symbol(s) in set WS associated with non-zero payout(s) and perhaps on the number of non-blanks NB. After determining PO, the gaming device can update the credit balance CB based on PO. For example, the gaming device could increase the credit balance CB by the payout value PO.

At block 150, the gaming device can determine whether input I is a move symbol input, i.e., a request to move a symbol S1 within grid G. If the gaming device determines that input I is a move symbol input, then the gaming device can proceed to block 152. Otherwise, the gaming device can determine that input I is not a move symbol input and can proceed to block 160.

At block 152, the gaming device can update the display to move symbol S1 in grid G according to the move input. For example, a player can swap selected symbol S1 located at grid position GP1 in grid G with another symbol S2 located at grid position GP2 in grid G by using the gaming device to drag-and-drop (or a similar user interface technique) symbol S1 onto grid position GP2. After the drag-and-drop, the gaming device can put symbol S1 into grid position GP2 and put symbol S2 into grid position GP1; thereby swapping positions of symbols S1 and S2. In some examples, the gaming device can swap symbols S1 and S2 only when one of S1 and S2 is a blank symbol and the other one of S1 and S2 is a non-blank symbol.

At block 160, the gaming device can determine whether input I is a save template input, i.e., a request to have the gaming device save a template T of grid G. If the gaming device determines that input I is a save template input, then the gaming device can proceed to block 162. Otherwise, the gaming device can determine that input I is not a save template input and can proceed to block 170.

At block 162, the gaming device can determine and then save a template T of grid G. Template T is described above in more detail at least in the context of blocks 110 and 112 of set of functions 100. For example, the gaming device can examine each grid location of grid G for a blank symbol and store row-column grid locations of blank symbols as template T, perhaps along with a number of blank symbols NB listed in template T. In some examples, a previous template T' can already be saved; in that case, the gaming device can overwrite previous template T' with template T, perhaps after saving a copy template T' for later use.

At block 170, the gaming device can determine whether input I is a select new symbol set input, i.e., a request to repopulate grid G with a new set of symbols. The new set of symbols can have a greater number, a fewer number, or the same number of blank symbols than the number NB of set S. As well, the new set of symbols can have a greater number, a fewer number, or the same number of non-blank symbols than the number NNB of set S. If the gaming device determines that input I is a select new symbol set input, then the gaming device can proceed to block 110. Otherwise, the gaming device can determine that input I is not a select new symbol set input and can proceed to block 124.

III. Example Architecture

Figure 2:
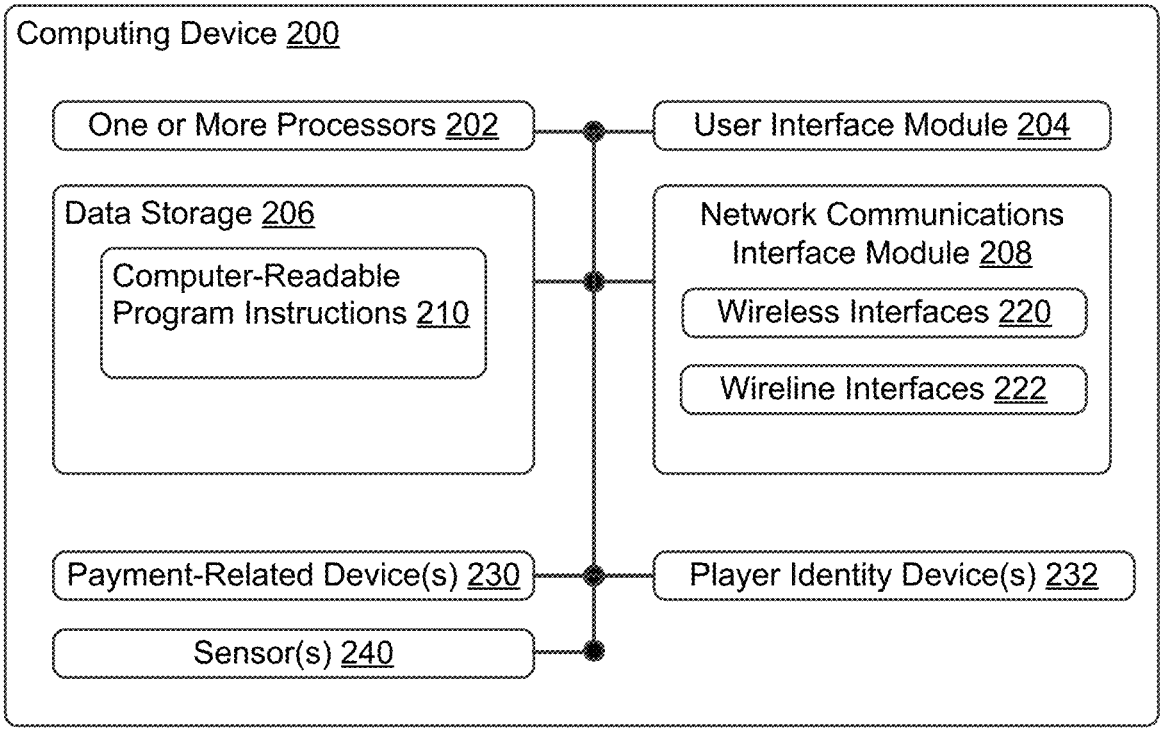
FIG. 2 is a simplified block diagram of a computing device, in accordance with example embodiments.

FIG. 2 is a block diagram of computing device 200, in accordance with example embodiments. In particular, computing device 200 can be configured to perform at least one herein-described function. For example, computing device 200 can be configured to perform at least one herein-described function related to: a computing device, a gaming device, sets of functions 100, environments 300, gaming device(s) 312, computing device(s) 322, server computing device(s) 330, data network 340, screen layout 400, tables 500, 510, 520*a*, 520*b*, 520*c*, 530, scenario 600, and method 1600.

Computing device 200 can include one or more mobile computing devices and/or one or more stationary computing devices. A mobile computing device, that is a computing device capable of operating, executing and providing services and applications that has is configured to be readily portable by a person and can portable components, such as mobile hardware, mobile (and perhaps rechargeable) power supplies, and mobile software. A stationary computing device is a computing device that is not a mobile computing device; that is, a computing device that may not be readily portable by a person Computing device 200 can include one or more processors 202, a user interface module 204, data storage 206, and network communications interface module 208, all of which can be linked together via a system bus, network, or other connection mechanism. Processor(s) 202 can include one or more general purpose processors and/or one or more special purpose processors. For example, processor(s) 202 can comprise one or more general purpose processors (e.g., Intel® single core microprocessors or Intel® multicore microprocessors) and/or one or more special purpose processors (e.g., application-specific integrated circuits (ASICs), graphics processing units (GPUs), field-programmable gate array (FPGAs), and/or digital signal processors (DSPs)). Processor(s) 202 can be configured to execute computer-readable program instructions 210 that are stored in data storage 206, software applications, and/or other instructions as described herein.

User interface module 204 can be operable to send data to and/or receive data from external user input/output devices. For example, user interface module 204 can be configured to send and/or receive data to and/or from user input devices such as a keyboard, a keypad, a touch screen, a computer mouse, a track ball, a joystick, a camera, a voice recognition module, a microphone and/or other sound detector, and/or other similar devices. User interface module 204 can also be configured to provide output to user display devices, such as one or more cathode ray tubes (CRT), liquid crystal displays, light emitting diodes (LEDs), displays using digital light processing (DLP) technology, printers, light bulbs, and/or other similar devices. User interface module 204 can also include one or more devices configured to generate audible output(s), such as a speaker, speaker jack, audio output port, audio output device, earphones, a bell, a horn, a siren, and/or other similar devices. Further, in some examples, user interface module 204 can also include one or more devices configured to generate haptic output(s) such as forces, vibrations, and/or motions detectable at least by a user's sense of touch. In some examples, computing device 200 can utilize user interface module 204 to present and/or receive content, such as audio content and/or video content.

Data storage 206 can include one or more computer-readable storage media that can be read, written, and/or otherwise accessed by at least one of processor(s) 202. The one or more computer-readable storage media can include volatile and/or non-volatile storage components, such as optical, magnetic, organic or other memory or disc storage, which can be integrated in whole or in part with at least one of processor(s) 202. In some examples, data storage 206 can be implemented using a single physical device (e.g., one optical, magnetic, organic or other memory or disc storage unit), while in other examples, data storage 206 can be implemented using two or more physical devices. In particular, data storage 206 can store computer-readable program instructions 210 and perhaps additional data. In some examples, data storage 206 can additionally include at least enough storage to perform at least part of the herein-described methods and techniques and/or at least part of the functionality of the herein-described computing devices and/or gaming devices. In other examples, data storage 206 can store one or more databases (e.g., a player credit account database), to allow for the storing and retrieving of data related to account balances, wagers, and/or other information associated with one or more players, computing devices, and/or gaming devices.

Network communications interface module 208 can include zero or more wireless interfaces 220 and/or zero or more wireline interfaces 222 that are configurable to communicate via a network. Wireless interfaces 220, if present, can utilize an air interface, such as a Bluetooth®, Wi-Fi®, ZigBee®, and/or WiMAX™ interface to a data network, such as a wide area network (WAN), a local area network (LAN), one or more public data networks (e.g., the Internet), one or more private data networks, or any combination of public and private data networks. Wireline interfaces 222, if present, can comprise a wire, cable, fiber-optic link and/or similar physical connection(s) to a data network, such as a WAN, LAN, one or more public data networks, one or more private data networks, or any combination of such networks. In some examples, some or all of wireless interfaces 220 and/or wireline interfaces 222 can interface with and enable communication with one or more voice networks.

In some examples, network communications interface module 208 can be configured to provide reliable, secured, and/or authenticated communications. For each communication described herein, information for ensuring reliable communications (i.e., guaranteed message delivery) can be provided, perhaps as part of a message header and/or footer (e.g., packet/message sequencing information, encapsulation header(s) and/or footer(s), size/time information, and transmission verification information such as cyclic redundancy check (CRC) and/or parity check values). Communications can be made secure (e.g., be encoded or encrypted) and/or decrypted/decoded using one or more cryptographic protocols and/or algorithms, such as but not limited to, Data Encryption Standard (DES), Advance Encryption Standard (AES), Rivest-Shamir-Adleman (RSA), Diffie-Hellman, and/or Digital Signature Algorithm (DSA). Other cryptographic protocols and/or algorithms can be used as well or in addition to those listed herein to secure (and then decrypt/decode) communications.

Each computer-readable storage medium (or, more simply "readable medium") described in this disclosure can include a non-transitory computer-readable medium that includes volatile and/or non-volatile storage components such as optical, magnetic, organic or other memory or disc storage, which can be integrated in whole or in part with a processor. Additionally or alternatively, each computer-readable medium described in this disclosure can include a transitory computer-readable medium. The transitory computer-readable medium can include, but is not limited to, a communications medium such as a digital or analogue communications medium (e.g., a fibre optic cable, a waveguide, a wired communication link, or a wireless communication line).

A network interface, such as network communication interface module 208 or any other network interface disclosed herein, can include an interface to one or more networks and/or communication channels. For example, the network interface can include one or more transmitters configured for transmitting data using the one or more networks and/or communication channels, one or more receivers configured for receiving data using the one or more networks and/or communication channels, and/or one or more transceivers configured to both transmit and receive data using the one or more networks and/or communication channels. In particular, the network interface can be used enable communications between one or more computing devices used by players and one or more gaming servers used to play games of chance and/or provide player accounting services (e.g., player identification, settling of wagers, etc.)

The network interface can further include one or more receivers configured to receive data transmitted over the network or communication channel from another device within or on the network or communication channel. Any of the network interfaces disclosed herein can include circuitry, for example electronic circuitry, for converting data received from the network or communication channel to data that can be provided to a processor for processing the received data. For example, the circuitry of the network interfaces can include a modulator and/or demodulator (modem). Any of the network interfaces disclosed herein can include circuitry, for example electronic circuitry, for converting data received from another device, such as a processor or a computer-readable medium, to data in a form that can be transmitted over a network or communication channel.

In some examples, computing device 200 can include one or more payment-related devices 230. Payment-related device(s) 230 can be configured to obtain, accept, and/or dispense payments at computing device 200. Payments can take the form of coins, currency, printed payment tickets, credit cards, and/or electronic payments. Payment-related device(s) 230 include, but are not limited to, one or more: bill acceptors, coin acceptors, bill dispensers, coin dispensers, payment ticket printers, payment ticket readers, credit card readers, and electronic payment processing hardware and/or software. More specifically, computing device 200 can physically dispense a corresponding payout (e.g., cash), or otherwise facilitate the payout to the player (by adding funds to an electronic account associated with a gaming card) using payment-related devices 230. Dispensing payments can be initiated by a cash out (or similar) button of computing device 200. Additionally or alternatively to determining the payout amount, computing device 200 may perform other actions to award a player. For instance, computing device 200 can display an indication of a tangible prize. Other examples of payment-related device(s) 230 and/or awards are possible as well.

In some examples, computing device 200 can include one or more player identity devices 232. Player identity device (s) 232 can be configured to obtain information that can identify a player. Player identity device(s) 232 include, but are not limited to, one or more: input devices configured to accept at least a player identifier, passphrase information, telephone numbers, and/or other data that can identify a player; card and/or ticket readers configured to read one or more cards and/or tickets that have player identification data that identifies a player; cameras and/or barcode scanners configured to read barcode and/or a quick response (QR) code that have player identification data that identifies a player; biometric sensors configured to obtain facial and/or other biometric information that can identify a player; and/or software related to a Game To System (G2S) and/or and a System To System (S2S) standard promulgated by the Gaming Standards Association that can be used to identify a player. Other examples of player identity device(s) 232 are possible as well.

In some examples, computing device 200 can include one or more sensors 240. Sensor(s) 240 can be configured to measure conditions in an environment for computing device 200 and provide data about that environment. For example, sensor(s) 240 can include one or more of: (i) an identification sensor to identify other objects and/or devices, such as but not limited to, a Radio Frequency Identification (RFID) reader, proximity sensor, one-dimensional barcode reader, two-dimensional barcode (e.g., Quick Response (QR) code) reader, and a laser tracker, where the identification sensor(s) can be configured to read identifiers, such as RFID tags, barcodes, QR codes, and/or other devices and/or object configured to be read and provide at least identifying information; (ii) a location sensor to measure locations and/or movements of the computing device 200, such as but not limited to, a gyroscope, an accelerometer, a Doppler sensor, a Global Positioning System (GPS) device, a sonar sensor, a radar device, a laser-displacement sensor, and a compass; (iii) an environmental sensor to obtain data indicative of an environment of computing device 200, such as but not limited to, an infrared sensor, an optical sensor, a light sensor, a camera, a biosensor, a capacitive sensor, a touch sensor, a temperature sensor, a wireless sensor, a radio sensor, a movement sensor, a microphone, a sound sensor, an ultrasound sensor, and/or a smoke sensor. Many other examples of sensor(s) 240 are possible as well.

Figure 3:
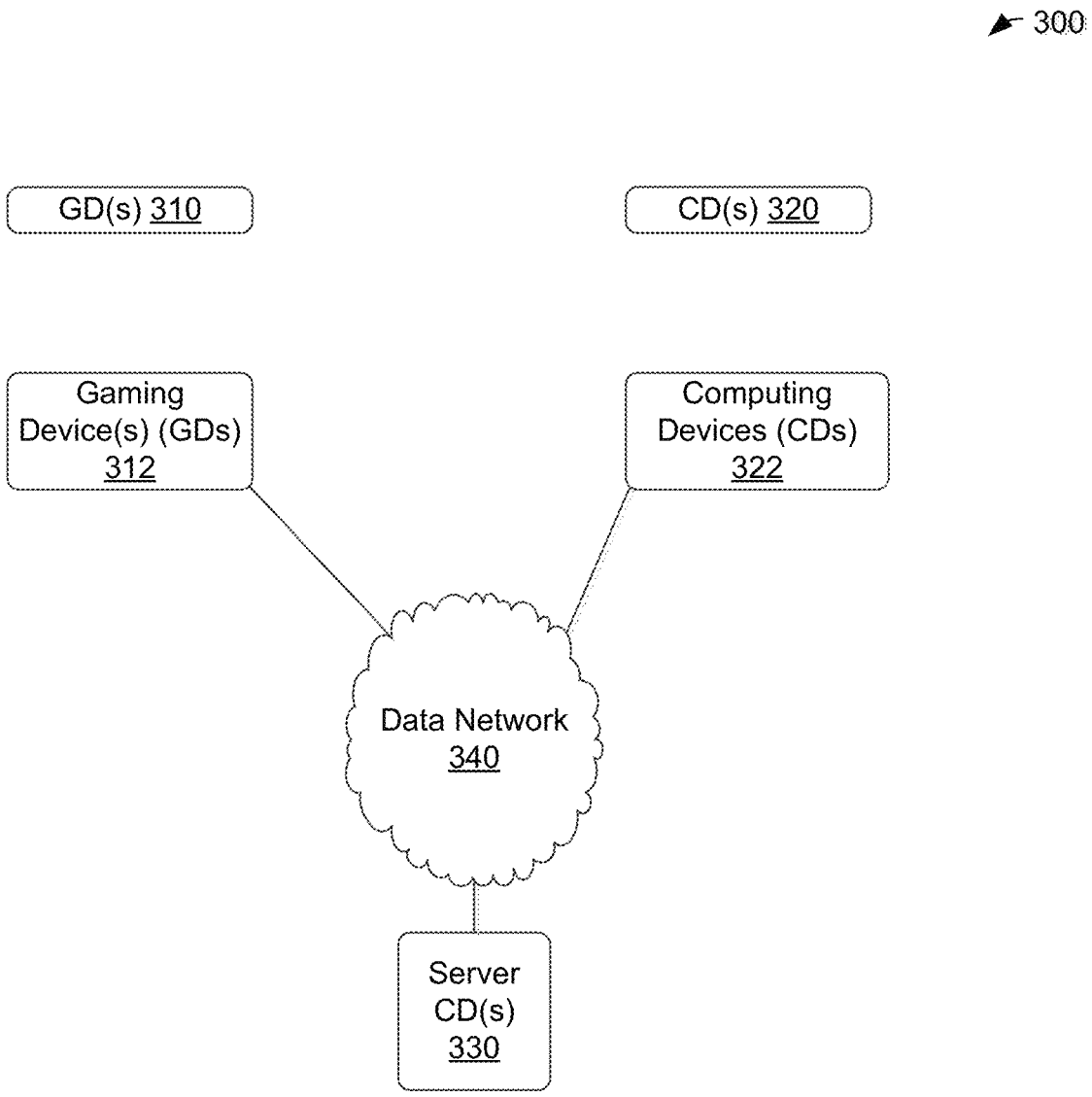
FIG. 3 is a simplified block diagram of an example environment, in accordance with example embodiments.

FIG. 3 is a simplified block diagram of environment 300, in accordance with example embodiments. Environment 300 includes one or more gaming devices (GDs) 310, one or more gaming devices 312 connected to data network 340, one or more computing devices (CDs) 320, one or more computing devices 322 connected to data network 340, and one or more server computing devices 330 also connected to data network 340. In some examples, some or all of gaming device(s) 310, 312, computing device(s) 320, 322, server computing device(s) 330, and computing components of data network 340 can be implemented using one or more computing devices, such as one or more of computing device 200.

Some or all of gaming device(s) 312, computing device(s) 322, and/or server computing device(s) 330 can be configured to communicate data with each other and perhaps with other computing devices using data network 340. Data network 340 can include any of a variety of network topologies and network devices, and may employ traditional network-related technologies, including for example the public switched telephone network, cable networks, cellular wireless networks, Bluetooth®, Wi-Fi®, ZigBee®, and/or WiMAX™ Data in data network 340 can be communicated as datagrams according to the user datagram protocol (UDP), the transmission control protocol (TCP), or another protocol.

Data network 340 in environment 300 may take a variety of forms. For example, environment 300 can include one or more casinos and data network 340 may be one or more local area networks (LANs) and/or one or more wide-area networks (WANs), such as an Internet network or a network of the World Wide Web. Then, gaming device(s) 310 and/or computing device(s) 320 dispersed throughout a casino of environment 300 can communicate with server computing device(s) 330 in the casino. In another example, gaming device(s) 310 and/or computing device(s) 320 can communicate with server computing device(s) 330 via a website portal (for a virtual casino) hosted on server computing device(s) 330. Other forms of data network 340 and/or environment 300 are possible as well.

Figure 4:
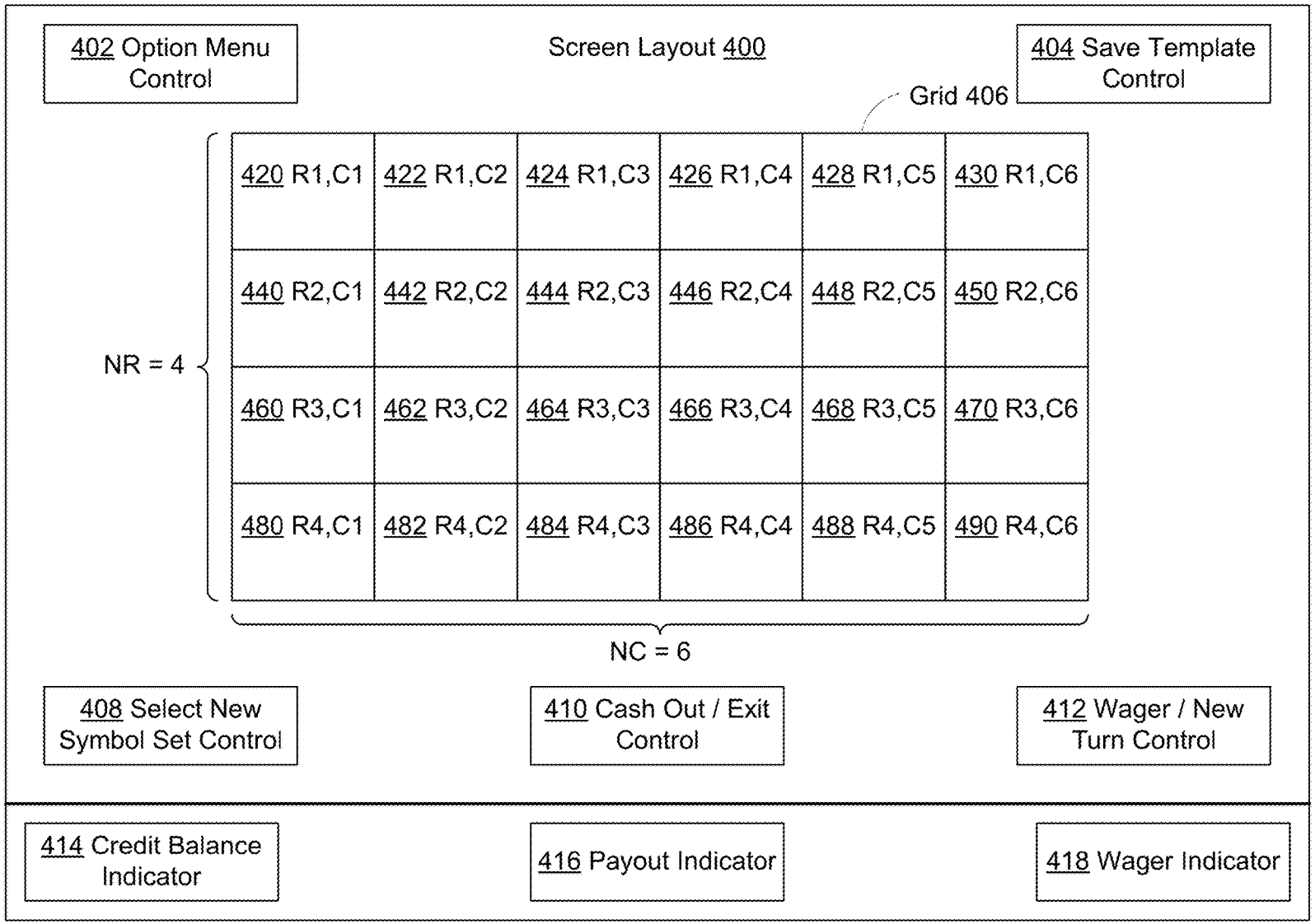
FIG. 4 depicts a screen layout of elements displayable by a computing device, in accordance with example embodiments.

FIG. 4 depicts screen layout 400 of elements that may be displayed by a computing device, such as being displayed using user interface module 204 of computing device 200, in accordance with example embodiments. Screen layout 400 can be used by a computing device acting as a gaming device to visually present or display aspects of the herein-described game, such as displays 700, 800, 900, 1000, 1100, 1200, 1300, 1400, and 1500 discussed below in the context of scenario 600 and FIGS. 6-15. For purposes of this description, some or all element of screen layout 400 can be provided by a computing device as a displayable element of a display.

Screen layout 400 includes options menu control 402, save template control 404, grid 406, select new symbol set control 408, cash out/exit control 410, wager/new turn control 412, credit balance indicator 414, payout indicator 416, and wager indicator 418.

Options menu control 402 can enable a user; e.g., a player of the herein-described game, to direct the gaming device to provide one or more options related to a display based on screen layout 400. The options can include, but are not limited to, options related to visual aspects of the display (e.g., text color, background color/imagery, enabling/disabling animations, symbol set appearance), options related to audible outputs of the gaming device (e.g., enabling/disabling some or all audible outputs, sound levels, selections of songs or other audio provided by the gaming device), and options related to user/player information (e.g., a preferred name for the user or player, accounting and/or payment-related information, login and/or other authentication characteristics for the player).

Save template control 404 can be selected by a user (player) to direct the gaming device to provide an input to the gaming device for saving a template of grid 406. Saving a template of a grid is discussed above at least in the context of FIG. 1.

Grid 406 can hold a set of symbols used for playing the herein-described game. In the example shown in FIG. 4, grid 406 has a number of rows NR equal to four and a number of columns NC equal to six for a total of NR×NC=24 grid positions. Each grid position in grid 406 can be used to display one blank symbol or one non-blank symbol of the set of symbols. The 24 grid positions are shown in FIG. 4 as grid positions 420, 422, 424, 426, 428, 430, 440, 442, 444, 446, 448, 450, 460, 462, 464, 466, 468, 470, 480, 482, 484, 486, 488, 490. A grid position in grid 406 can be accessed by providing pair specified as (row, column); e.g., a row-column pair of (2, 4) specifies row 2, column 4 in grid 406, which corresponds to grid position 446. As shown in FIG. 4, grid position 446 includes a notation "R2, C4" which specifies that grid position 446 is in row two ("R2") and column four ("C4") of grid 406. In this example, the R2, C4 notation for grid position 446 corresponds to the row-column pair (2, 4). Other example grids; e.g., grids having more, fewer, and/or different numbers of rows and/or columns are possible as well.

Select new symbol set control 408 can be selected by a user (player) to enable the user (player) to provide an input to the gaming device for selecting a new symbol set to be displayed in grid 406. Selecting a new symbol set for a grid is discussed above at least in the context of FIG. 1.

Cash out/exit control 410 can be selected by a user (player) to enable the user (player) to provide an input to the gaming device to cash out the user (player) and cease playing the herein-described game. Cashing out a user (player) and ceasing playing the herein-described game is discussed above at least in the context of FIG. 1.

Wager/new turn control 412 can be selected by a user (player) to enable the user (player) to provide an input to the gaming device to provide a wager to the gaming device as part of playing a new turn of the herein-described game. Providing a wager to the gaming device and/or playing a new turn of the herein-described game is discussed above at least in the context of FIG. 1.

Credit balance indicator 414 can display a most recent credit balance, which may indicate a number of credits available to a user (player) for wagering. Payout indicator 416 can display a most recent payout value, which may correspond to a number of credits most recently paid to a user (player) during game play. Wager indicator 418 can display a most recent wager value, which may correspond to a number of credits most recently bet or wagered by the user (player). In other examples, screen layout 400 can include more, fewer, and/or different controls and/or indicators than shown in FIG. 4.

FIG. 5 depicts tables 500, 510, 520*a*, 520*b*, 520*c*, 530 that can be used by a computing device acting as a gaming device to play the herein-described game, in accordance with example embodiments. Pay table 500 and blank multiplier table 510 can be used together to determine payout for the herein-described game.

FIG. 5 shows that pay table 500 includes entries having symbol field 502 and corresponding payout field 504 and that blank multiplier table 510 includes entries having a number of blanks (NB) field 512 and a blank multiplier (BM) field 514. In this example, pay table 500 includes Nsym entries, with one entry for each of the Nsym symbols Sym1, Sym2 Sym_Nsym in set S and corresponding respective payout values Pay1, Pay2 . . . Pay_Nsym. In this example, blank multiplier table 510 includes GC-2=(NR×NC)−2 entries.

When the gaming device determines a winning symbol WS1 during the herein-described game, the gaming device can search for winning symbol WS1 in symbol field 502 of entries in pay table 500. After finding an entry E1 for winning symbol WS1 in pay table 500, a payout can be determined based on a payout value in payout field 504 for entry E1. The gaming device can also determine a number of blanks NB1 in a grid that includes winning symbol WS1 and search for NB1 among the entries for NB in blank multiplier table 510. A blank multiplier, or value to scale a payout based on a number of blanks, can be calculated using a formula, such as shown in FIG. 5, where values of blank multiplier BM as shown as being calculated using the formula $$\text{“int}\left[\frac{GC}{(GC-x)}\right]\text{”}$$

with “GC=NR×NC”. In this formula, “int[ ]” returns an integer part of its operand, GC equals the number of columns multiplied by the number of rows in the grid that includes winning symbol WS1, and x equals the number of blank symbols in the grid that includes winning symbol WS1. For example, if GC=36 and x=6, then int(36/(36−6)) =int(36/30)=int(1.2)=1, so the resulting blank multiplier would be 1. Other formulas (e.g., formulas that use rounded values rather than integer part values, formulas that may have non-integer values) and/or techniques can be used to determine blank multipliers as well.

Once a payout value and a blank multiplier have been determined for a winning symbol, such as WS1, the gaming device can determine an actual payout using the determined payout and blank multiplier values. FIG. 5 shows an example formula for determining an actual payout “APay” when the winning symbol is “Sym1” (e.g., the first symbol shown in pay table 500) as “APay=Pay1*BM(y), 1≤y≤(GC−1)”, where Pay1 stands for the payout value in payout field 504 for an entry of pay table 500 whose symbol field 502 has winning symbol Sym1, and BM(y) is the blank multiplier for a value of y blank symbols in the grid with winning symbol Sym1 as determined using blank multiplier table 510. The actual payout can be used as a payout value; e.g., payout value PO of set of functions 100.

Pay tables 520, which include pay tables 520*a*, 520*b*, and 520*c*, can include one pay table for each possible value of the number of blank symbols in the grid with the winning symbol. Pay tables 520*a*, 520*b*, 520*c* are similar to pay table 500, in that each respective pay table 520*a*, 520*b*, 520*c* of pay tables 520 includes Nsym entries for symbols Sym1, Sym2 Sym_Nsym in set S and corresponding respective payout values, where Nsym equals the number of unique non-blank symbols in set S. In some cases, Nsym equals the number of unique non-blank symbols in set S+1 for a blank symbol. Payout values in pay tables 520*a*, 520*b*, and 520*c* for a same symbol can vary, as the payout values in pay tables 520 are adjusted for a number of blank symbols in the grid with a winning symbol.

FIG. 5 shows that pay table 520*a* can be selected when NB, which is the number of blank symbols in the grid with the winning symbol, equals 1, pay table 520*b* can be selected when NB equals 2 and so on until pay table 520*c*, which can be selected when NB equals GC−1. In this example, the minimum value of NB is one and the maximum value of NB is GC−1. In other examples, different minima and/or maxima can be used.

Payout fields 524*a*, 524*b*, 524*c* corresponding to respective symbol fields 522*a*, 522*b*, 522*c* in respective pay tables 520*a*, 520*b*, 520*c* can be scaled or otherwise adjusted based on a value of NB associated with the respective pay table. For example, a value “Pay1_2” in payout field 524*b* of an entry for a symbol “Sym1” in symbol field 522*b* of pay table 520*b* can be larger than or equal to a value “Pay1_1” of payout field 524*a* for an entry for the same symbol “Sym1” in symbol field 522*a* of pay table 520*a*. In this example, the value “Pay1_2” of payout field 524*b* associated with symbol 522*b* “Sym1” in pay table 520*b* can be smaller than or equal to a value “Pay1 GC−1” of payout field 524*c* associated with same symbol “Sym1” in pay table 520*c*. As such, payout values in pay tables 520 can be used as actual payout values as they have already been adjusted based on a number of blank symbols. Thus, a payout value stored in a pay table of pay tables 520 can be used as an actual payout value, such as payout value PO described above in relation to FIG. 1.

Pay table 530 shows a single pay table that can be used to combine multiple pay tables that are each scaled for numbers of blank symbols; e.g., the multiple pay tables 520. Pay table 530 includes a number of entries each having a symbol field 532, a number of blanks field 534, and payout field 536. In particular, pay table 500 includes (GC−2) entries for each of Nsym symbols Sym1, Sym2 . . . Sym_Nsym with one entry per symbol per each possible value of NB, for a total of Nsym*(GC−2) entries.

FIG. 5 shows that pay table 530 includes actual payout values Pay1_1, Pay1_2, . . . Pay1_PayGC−1, Pay2_1, Pay2_2, . . . Pay_Nsym_GC−1. In pay table 530, payout value Pay1_1 is an actual payout value for a first symbol "Sym1" of pay table 530 in a grid having one blank symbol, payout value Pay1_2 is an actual payout value for the first symbol for a grid having two blank symbols, and so on until reaching payout value Pay1_PayGC−1, which is an actual payout value for the first symbol for a grid having GC−1 blank symbols. Pay table 530 continues with payout value Pay2_1 as an actual payout value for a second symbol "Sym2" of pay table 530 in a grid having one blank symbol, payout value Pay2_2 as an actual payout value for a second symbol "Sym2" of pay table 530 in a grid having two blank symbols, and so on, until reaching payout value Pay2_PayGC−1, which is an actual payout value for the second symbol for a grid having GC−1 blank symbols. The entries of pay table 530 include entries for all Nsym symbols, with a final entry for payout value Pay_Nsym_GC−1, which is an actual payout value for an $Nsym^{th}$ symbol "Sym_Nsym" of pay table 530 for a grid having GC−1 blank symbols. Other orderings of pay table 530 are possible as well.

IV. Example Scenarios

FIGS. 6, 7, 8, 9, 10, 11, 12, 13, 14, and 15 illustrate scenario 600 taking place in environment 300, in accordance with example embodiments. Scenario 600 begins with player 602 using gaming device 604 to start playing the herein-described game with an initial credit balance of 100 credits. In scenario 600, gaming device 604 uses set of functions 100 to play the herein-described game using a grid having four rows and nine columns of symbols. Gaming device 604 selects an initial set S of symbols for the 4×9 grid, where S has nine blank symbols and 27 non-blank symbols. Gaming device 604 then shows the selected grid of symbols in a display that is based on screen layout 400.

Scenario 600 continues with player 602 making a first wager of 2 credits to begin playing the herein-described game. The first wager of 2 credits is accepted by gaming device 604, which then plays a first turn of the game by selecting three winning symbols, updating the display based on the winning symbols, and determining an actual payout for the first turn of 0 credits, leaving a credit balance of 98 credits for player 602.

Later, player 602 provides an input to gaming device 604 to swap symbols at grid locations (3, 3) and (4, 2), where these grid locations are specified as row-column pairs. In response, gaming device 604 swaps the symbols at grid locations (3, 3) and (4, 2) and updates the display to reveal the now-swapped symbols. Player 602 then provides an input to gaming device 604 to save a template of the grid. In response, gaming device 604 saves a template T and updates the display to inform the player that the template has been saved. Player 602 then provides an input to gaming device 604 to select new symbol set for the grid. In response, gaming device 604 selects a new symbol set, places the new symbols in alignment with template T, and updates the display to show the new symbol set.

Scenario 600 continues with player 602 making a second wager of 2 credits to begin a second turn of the herein-described game. The second wager of 2 credits is accepted by gaming device 604, which then plays a second turn of the game by selecting three winning symbols. The winning symbols of the second turn include a trigger symbol. After selecting the trigger symbol as a winning symbol, gaming device 604 responsively updates the display to provide an animation of the seven additional winning symbols, and also separately displays the seven additional winning symbols. Gaming device 604 also determines a payout for the second turn of 104 credits, resulting in a credit balance of 200 credits for player 602. Subsequently, player 602 then provides an input to gaming device 604 to cash out. In response, gaming device 604 prints a payment ticket for 200 credits and displays a cash out confirmation message to end scenario 600.

Figure 6:
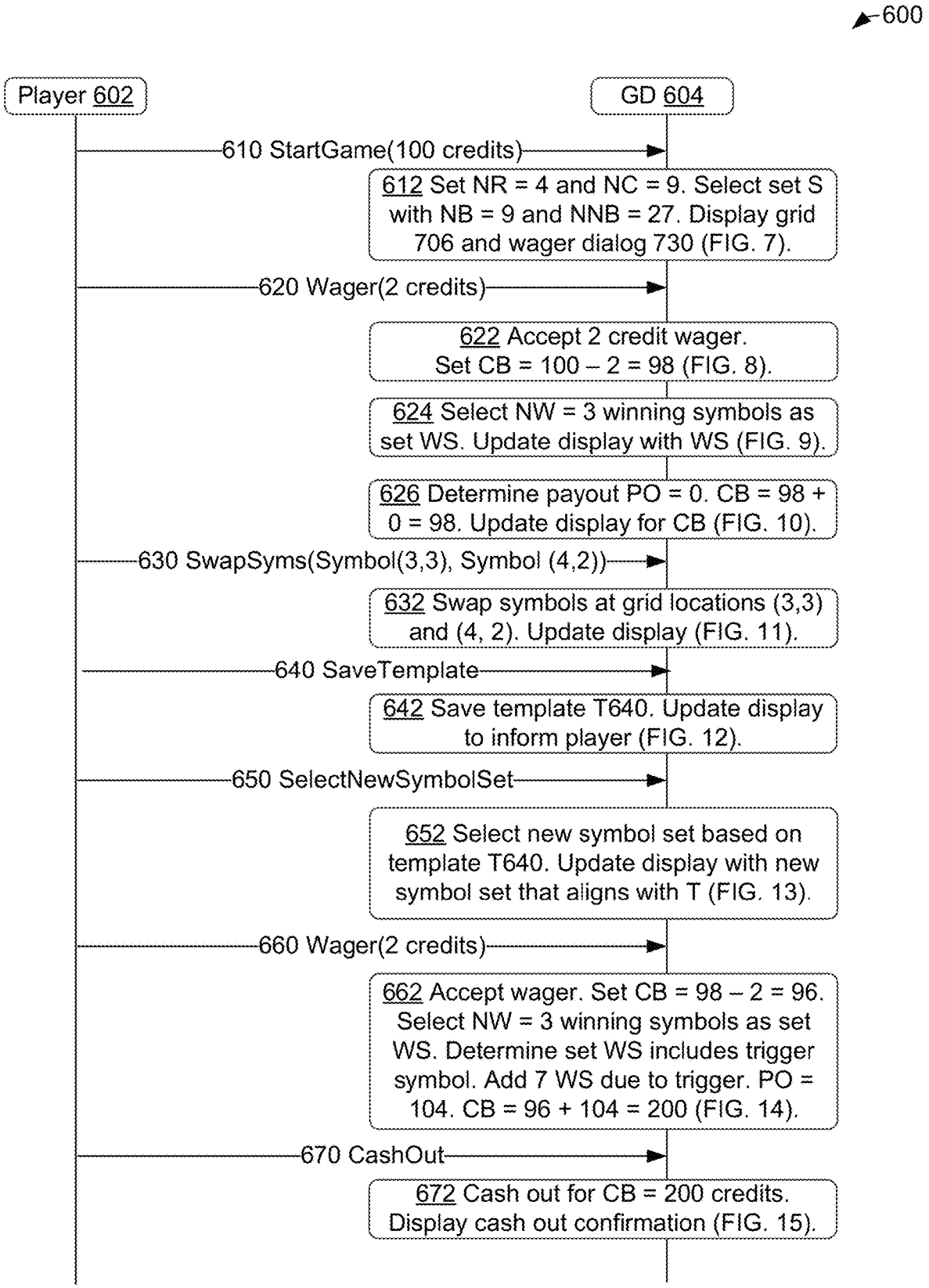
FIGS. 6, 7, 8, 9, 10, 11, 12, 13, 14, and 15 illustrate a scenario taking place in the environment of FIG. 3, in accordance with example embodiments.

FIG. 6 shows that scenario 600 begins with player 602 sending StartGame message 610 to gaming device 604 to start playing the herein-described game with an initial credit balance of 100 credits. The herein-described game of scenario 600 utilizes a grid with 4 rows and 9 columns for a total of 36 grid positions.

Gaming device 604 utilizes the procedures of set of functions 100 to play the herein-described game. In particular, upon reception of StartGame message 610, gaming device 604 utilizes the procedures of block 110 of set of functions 100 to determine that no template is available at this stage of scenario 600 and proceeds to block 120 of set of functions 100 to select set of symbols S, as indicated in block 612 of FIG. 6. In particular, block 612 indicates that gaming device 604 determines number of rows NR to be equal to four and number of columns NC to be equal to nine. Gaming device 604 also selects a set S of symbols for the herein-described game with nine blank symbols (e.g., NB=9) and the remaining symbols of set S to be non-blank symbols (e.g., NNB=27), as also indicated in block 612. After selecting the set S, gaming device 604 then uses the procedures of block 122 to show the selected grid of symbols in a display that is based on screen layout 400.

Figure 7:
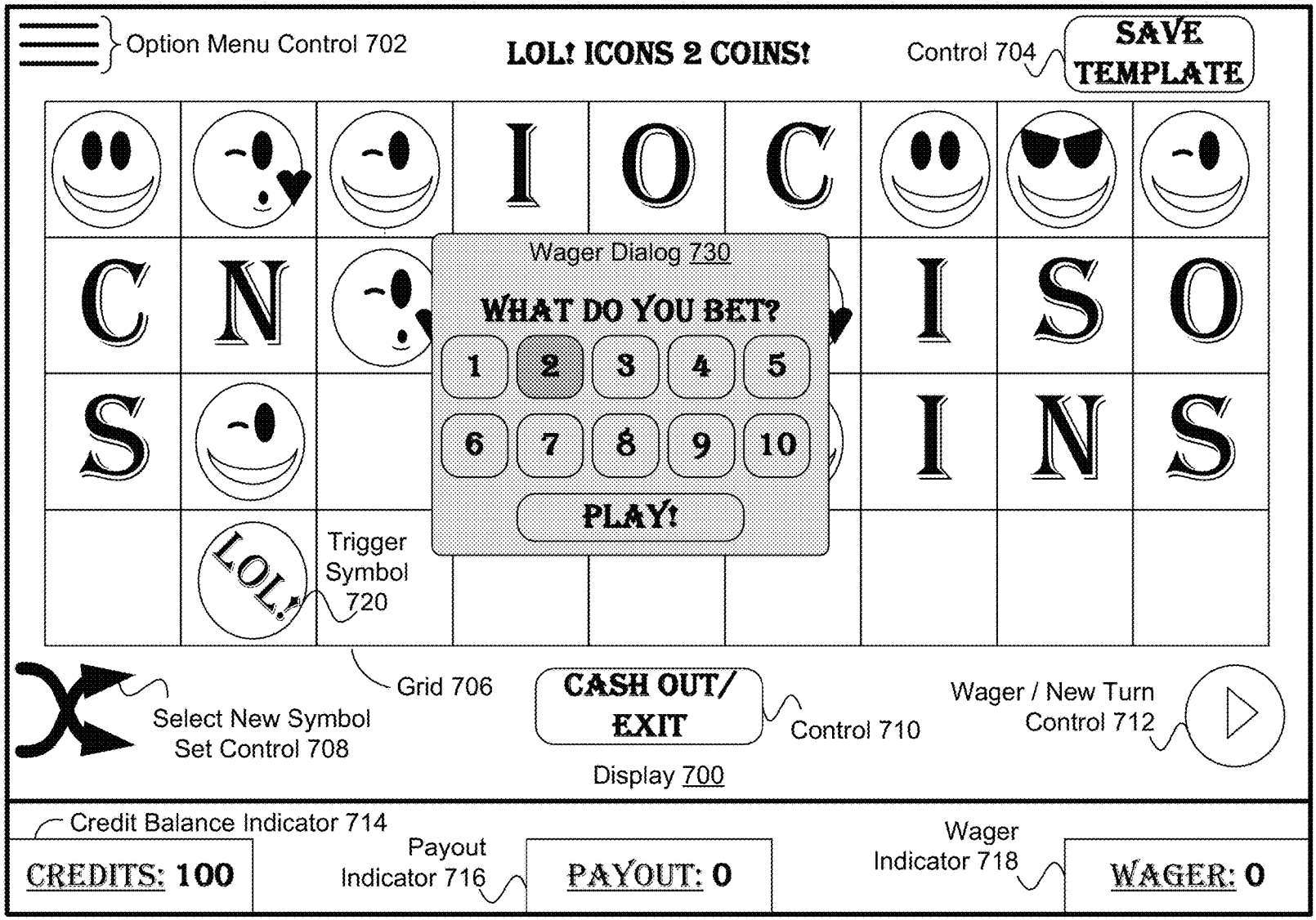

FIG. 7 shows display 700, which is the display of gaming device 604 that presents grid 706 as the selected grid of symbols. Each of displays 700, 800, 900, 1000, 1100, 1200, 1300, 1400, and 1500 are based on screen layout 400, where screen layout 400 is discussed above in the context of FIG. 4.

FIG. 7 shows that display 700 includes options menu control 702, save template control 704, grid 706, select new symbol set control 708, cash out/exit control 710, wager/new turn control 712, credit balance indicator 714, payout indicator 716, and wager indicator 718.

Options menu control 702 can enable a user of gaming device 604 (player 602 in scenario 600, to direct the gaming device to provide one or more options related to display 700. The options can include, but are not limited to, the options discussed above in the context of options menu control 402 of screen layout 400. Save template control 704 can be selected by a user of gaming device 604 (e.g., player 602), to enable the user to provide an input to the gaming device for saving a template of grid 706. Saving a template of a grid is discussed above at least in the context of FIGS. 1 and 4.

Grid 706 can hold a set of symbols used for playing the herein-described game. In the example shown in FIG. 7, grid 706 has a number of rows NR equal to four and a number of columns NC equal to nine for a total of NR×NC=36 grid positions. Each grid position in grid 706 can be used to display one blank symbol or one non-blank symbol of a set of symbols; e.g., set of symbols S of set of functions 100. A grid position in grid 706 can be accessed by providing pair specified as (row, column); e.g., a row-column pair of (2, 1) specifies row 2, column 1 in grid 706, which FIG. 7 shows is an "C" symbol.

FIG. 7 shows that grid 706 is populated with a set of symbols. The set of symbols include letters and images; e.g., display 700 shows that grid 706 includes a symbol of a smiling image at grid position (1, 1) and includes a symbol of a letter "S" at grid position (3, 1).

The set of symbols of grid 706 also include trigger symbol 720, depicted in FIG. 7 as a circle and characters "LOL!" When gaming device 604 selects trigger symbol 720 as a winning symbol, a bonus feature is activated. The bonus feature involves the set of NW winning symbols being augmented by x additional symbols randomly selected from the symbol set (e.g., x could be a predetermined or randomly chosen integer in the range of 1-10). The resulting augmented set of NW+x selected symbols is compared to one or more pay tables, such as one or more of tables 500, 510, 520*a*, 520*b*, 520*c*, 530, and any winning symbol combinations for all NW+x symbols are paid out.

A payout of the herein-described game can be based on a wager W, the determined winning symbol(s) in set WS including any additional symbols added in response to receiving the trigger symbol, and the number of blank symbols NB. In some examples, the payout is not directly associated with the trigger symbol; rather, the payout of the trigger symbol is determined as the sum of payouts of the additional symbols triggered by a winning trigger symbol. In other examples, the trigger symbol can have its own payout and any additional symbols triggered by the winning trigger symbol can provide additional payouts.

Select new symbol set control 708 can be selected by a user of gaming device 604; e.g., player 602, to enable the user to provide an input to the gaming device for selecting a new symbol set to be displayed in grid 706. Selecting a new symbol set for a grid is discussed above at least in the context of FIGS. 1 and 4.

Cash out/exit control 710 can be selected by a user of gaming device 604 (e.g., player 602), to enable the user to provide an input to the gaming device to cash out the user (player) and cease playing the herein-described game. Cashing out a user and ceasing playing the herein-described game is discussed above at least in the context of FIGS. 1 and 4. Wager/new turn control 712 can be selected by a user of gaming device 604 (e.g., player 602), to enable the user to provide a wager to the gaming device as part of playing a new turn of the herein-described game. Providing a wager to the gaming device and/or playing a new turn of the herein-described game is discussed above at least in the context of FIGS. 1 and 4.

Credit balance indicator 714 can display a most recent credit balance, i.e., a number of credits available to the user (e.g., player 602) for wagering during game play. Payout indicator 716 can display a most recent payout value, i.e., a number of credits most recently paid to a user of gaming device 604 (e.g., player 602) during game play. Wager indicator 718 can display a most recent wager value or number of credits most recently bet or wagered by a user of gaming device 604 (e.g., player 602) during game play. In display 700 shown in FIG. 7, credit balance indicator 714 displays "100" credits received in StartGame message 610, payout indicator 716 displays "0" as no payouts have yet been made, and wager indicator 718 displays "0" as no wagers have yet been made.

At this stage of scenario 600, player 602 has yet to make a wager. To aid player 602 in wagering, display 700 includes wager dialog 730. Wager dialog 730 enables player 602 to make a wager of "1", "2", "3", "4", "5", "6", "7", "8", "9", or "10" credits by selecting an appropriate numbered button of wager dialog 730, and to confirm the wager by selecting the "PLAY!" button of wager dialog 730. After providing display 700, gaming device 604 uses the procedures of block 124 of set of functions 100 to wait to receive an input from player 602.

FIG. 6 shows that scenario 600 continues with player 602 using wager/new turn control 712 and wager dialog 730 to provide Wager message 620 as an input to gaming device 604 to make a first wager of "2 credits" and begin playing the herein-described game. After receiving Wager message 620, gaming device 604 proceeds from block 124 of set of functions 100, through blocks 130 and 140 to arrive at block 142 of set of functions 100. Block 622 shows that gaming device 604 accepts the wager of two credits and subtracts two credits from the credit balance CB of 100 credits, thereby updating the credit balance CB to be 98 credits.

Figure 8:
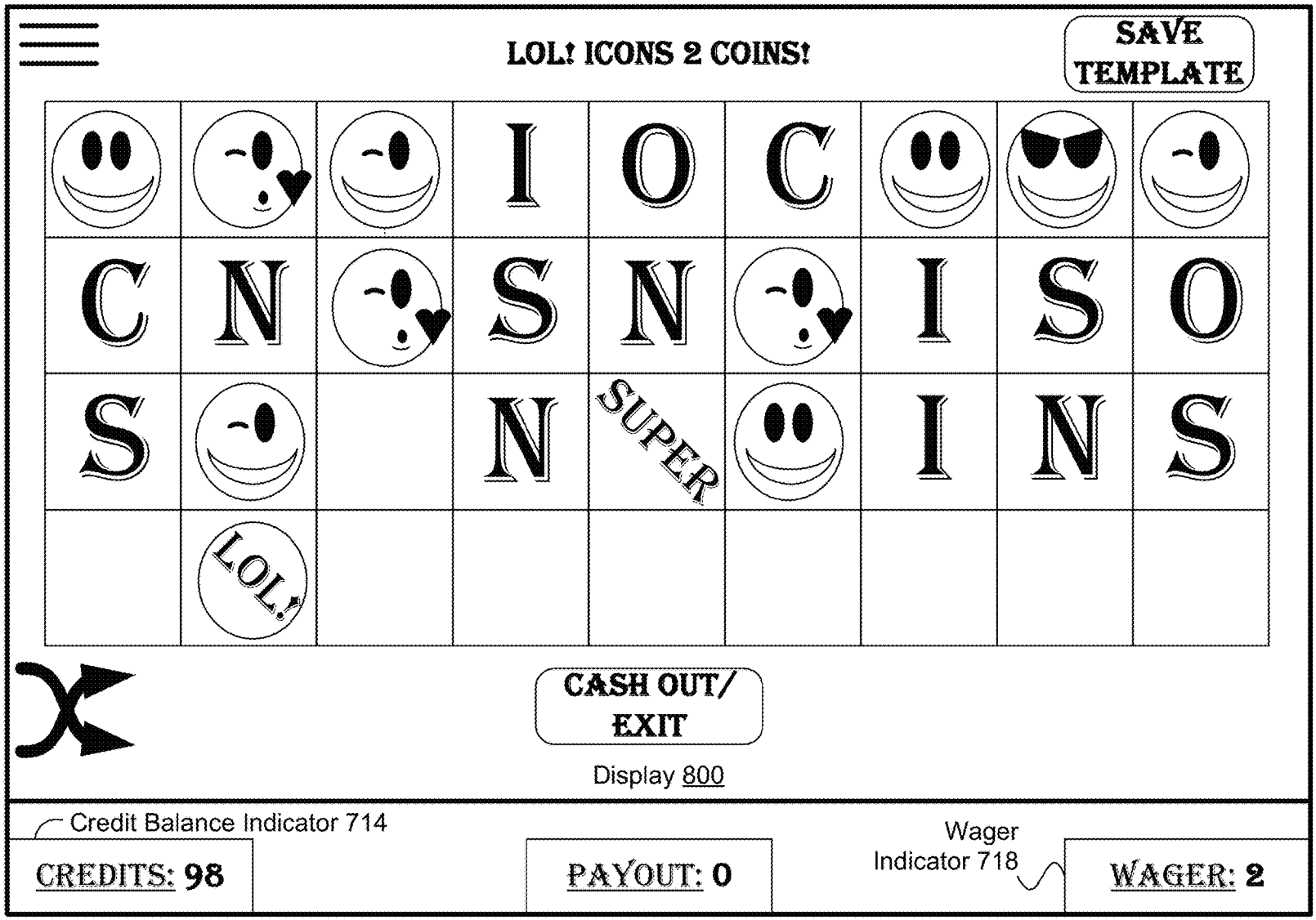

FIG. 8 depicts display 800, which is the display of gaming device 604 after the wager made using Wager message 620 has been accepted. Display 800 reflects events of scenario 600 that have occurred since display 700 was provided. Display 800 updates display 700 by removing wager dialog 730, updating credit balance indicator 714 to show that player 602 now has "98" credits, and updating wager indicator 718 to show that player 602 has made a wager of "2" credits.

Block 624 of FIG. 6 indicates that gaming device 604 proceeds with a first turn of the game. In particular, gaming device 604 proceeds to block 144 of set of functions 100 to select a number of winning symbols NW equal to 3 and selects NW (3) winning symbols as set WS for the first turn. As part of the procedures of block 144, gaming device 604 then updates the display to inform player 602 of the winning symbols.

Figure 9:
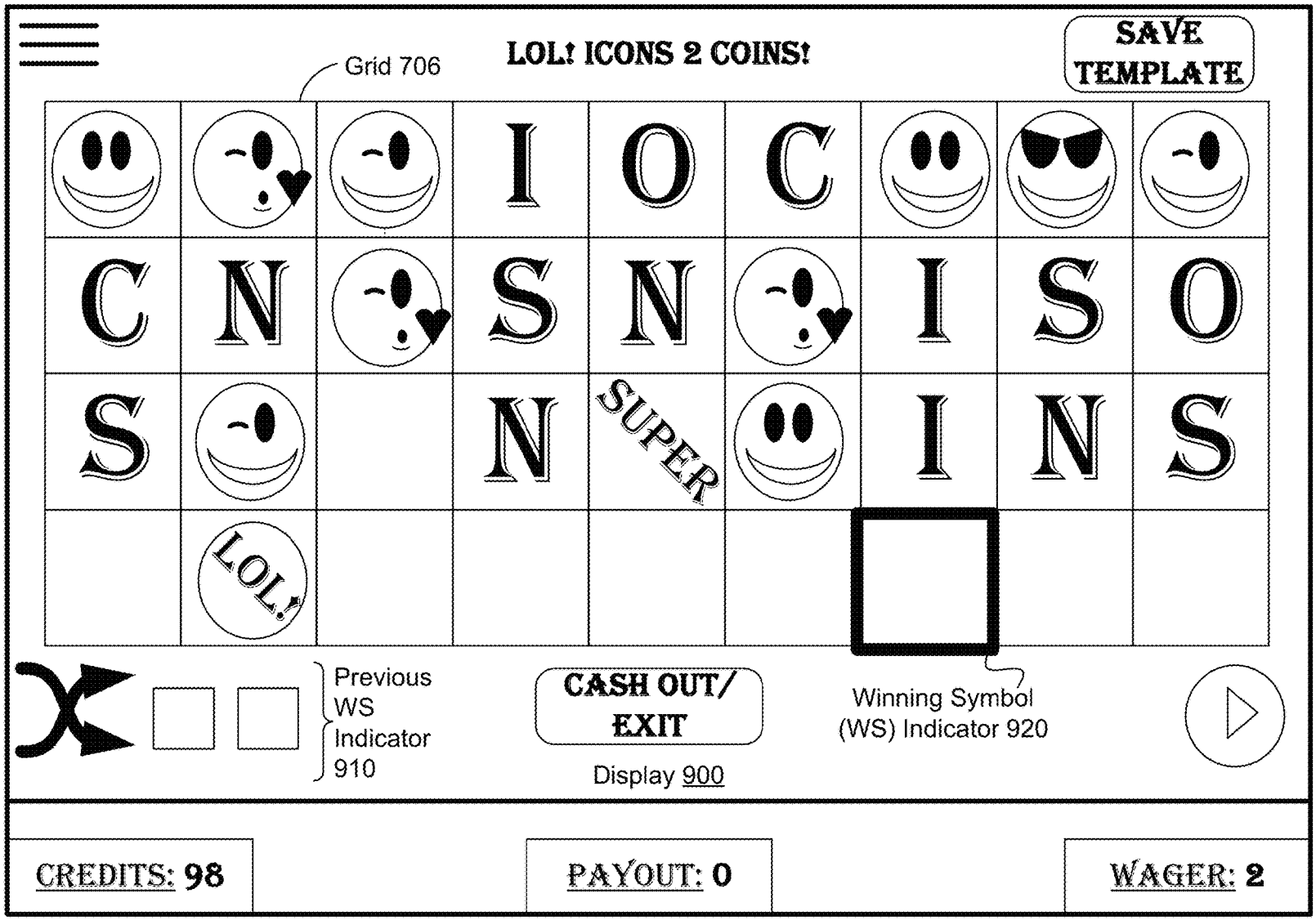

FIG. 9 depicts display 900, which is the display of gaming device 604 in the process of informing player 602 of the third winning symbol in set WS. Display 900 reflects events of scenario 600 that have occurred since display 800 was provided. Display 900 updates display 800 by presenting previously-presented winning symbols in set WS as previous winning symbol (WS) indicator 910 and presenting winning symbol indicator 920. Previous winning symbol indicator 910 shows two previously-presented winning symbols. In this example, the two previously-presented winning symbols are blank symbols, shown in FIG. 9 as white rectangles. Winning symbol indicator 920, shown in FIG. 9 as a black border of grid location (4, 7) of grid 706, indicates to player 602 which symbol in grid 706 is a current winning symbol. In this example, winning symbol indicator 920 indicates that the blank symbol at grid location (4, 7) is the third winning symbol in set WS.

Block 626 of FIG. 6 indicates that gaming device 604 proceeds with the first turn of the game. In particular, gaming device 604 carries out block 146 of set of functions 100 to determine a payout PO of 0 credits based on the winning symbols selected at block 624. Block 626 also shows that gaming device 604 updating the credit balance CB to add the zero payout PO to the credit balance, leaving CB equal to 98 credits. After updating credit balance CB, gaming device 604 proceeds through blocks 150, 160, and 170 of set of functions 100 to arrive at block 124.

Figure 10:
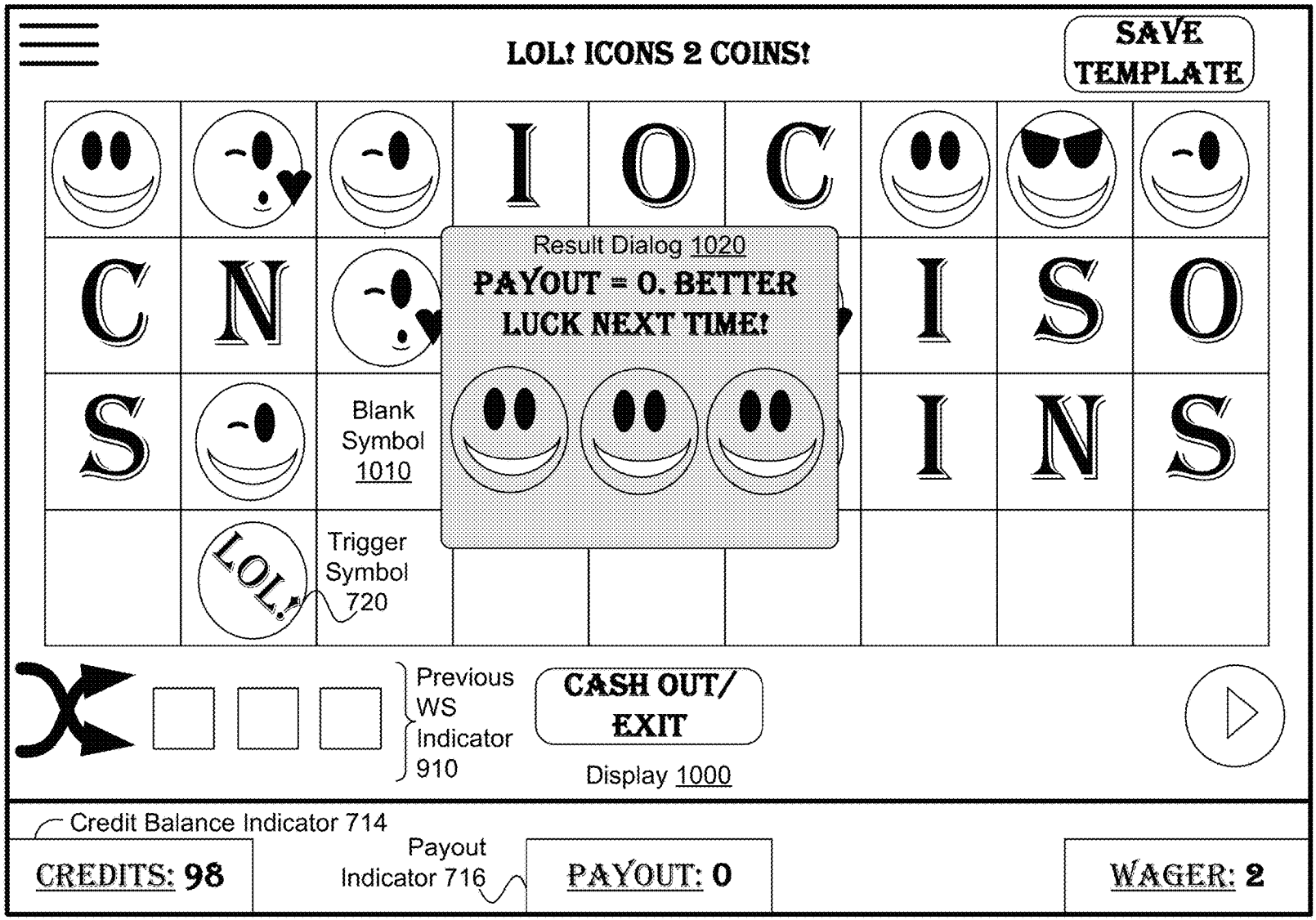

FIG. 10 depicts display 1000, which is the display of gaming device 604 after the credit balance has been updated based on payout PO determined at block 626. Display 1000 reflects events of scenario 600 that have occurred since display 900 was provided. Display 1000 updates display 900 by making a null update to credit balance indicator 714 to add the payout of 0 credits for a credit balance of "98" credits, making a null update of payout indicator 716 to display a payout of "0" credits for the first turn of scenario 600, adding the third winning symbol from grid location (4, 7) mentioned above to previous winning symbol indicator 910 as a third white rectangle, removing winning symbol indicator 920 from grid 706, and adding results dialog 1020. Results dialog 1020 informs player 602 that "PAYOUT=0" and provides a message of "BETTER LUCK NEXT TIME" with three images of smiling faces. After providing display 1000, gaming device 604 uses the procedures of block 124 of set of functions 100 to wait to receive a next input from player 602.

FIG. 6 shows that scenario 600 continues with player 602 dragging and dropping a symbol at grid location (3, 3) of grid 706 to grid location (4, 2) of grid 706 to provide SwapSyms message 630 as an input to gaming device 604. SwapSyms message 630 directs a swap of two symbols a "Symbol" at row-column grid location "3, 3" with a "Symbol" at row-column grid location "4, 2". Gaming device 604 interprets SwapSyms message 630 as a move symbol input from player 602 and proceeds through blocks 130, 140, and 150 of set of functions 100 to arrive at block 152 to process SwapSyms message 630. As illustrated by block 632 of FIG. 6, gaming device 604 uses the techniques of block 152 of set of functions 100 to swap the symbols at row-column grid locations (3,3) and (4, 2) and updates the display to show player 602 that the symbols at row-column grid locations (3,3) and (4, 2) have been swapped.

Figure 11:
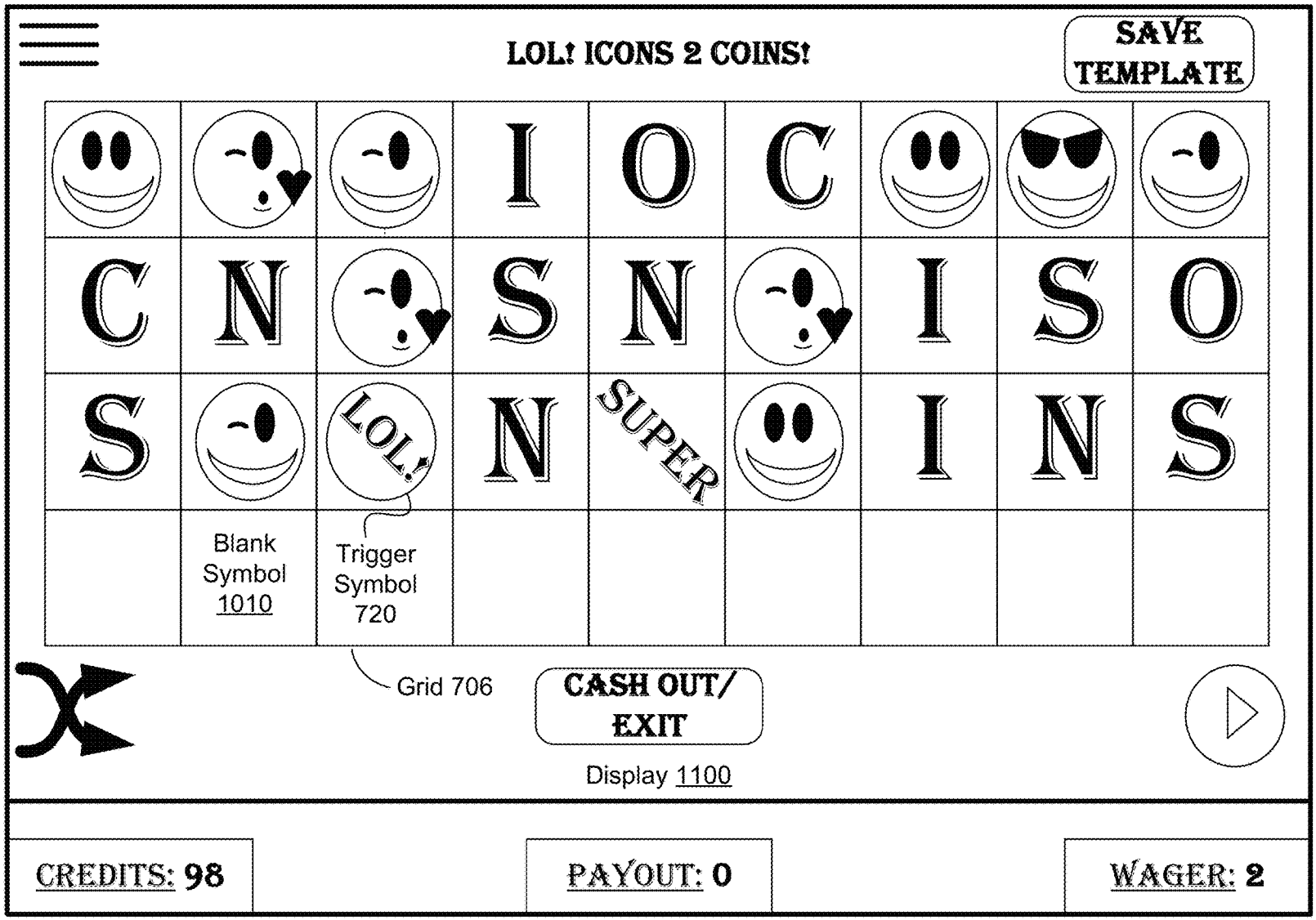

FIG. 11 depicts display 1100, which is the display of gaming device 604 after the symbols at row-column grid locations (3, 3) and (4, 2) have been swapped at block 632. Display 1100 reflects events of scenario 600 that have occurred since display 1000 was provided. Display 1100 updates display 1000 by removing previous winning symbol indicator 910 and results dialog 1020 and displaying grid 706 after the symbols at row-column grid locations (3, 3) and (4, 2) have been swapped. More particularly, display 1000 shows that grid location (3, 3) of grid 706 has blank symbol 1010 and grid location (4, 2) of 706 has trigger symbol 720, whereas display 1100 shows that grid location (3, 3) of grid 706 has trigger symbol 720 and grid location (4, 2) of 706 has blank symbol 1010. Thus, the symbols of grid location (3, 3) and grid location (4, 2) have been swapped. After providing display 1100, gaming device 604 proceeds through blocks 160 and 170 of set of functions 100 to arrive at block 124 of set of functions 100.

FIG. 6 shows that scenario 600 continues with player 602 using save template control 704 to provide SaveTemplate message 640 as an input to gaming device 604 to save a template of a currently-displayed grid, in this case, grid 706 currently displayed by display 1100 as shown in FIG. 11. Gaming device 604 proceeds through blocks 130, 140, 150, and 160 of set of functions 100 to arrive at block 162 to process SaveTemplate message 640.

As illustrated by block 642 of FIG. 6, gaming device 604 uses the techniques of block 162 of set of functions 100 to save a template "T640" of the currently-displayed grid. Gaming device 604 also updates the display to inform player 602 that the template T640 has been saved.

Figure 12:
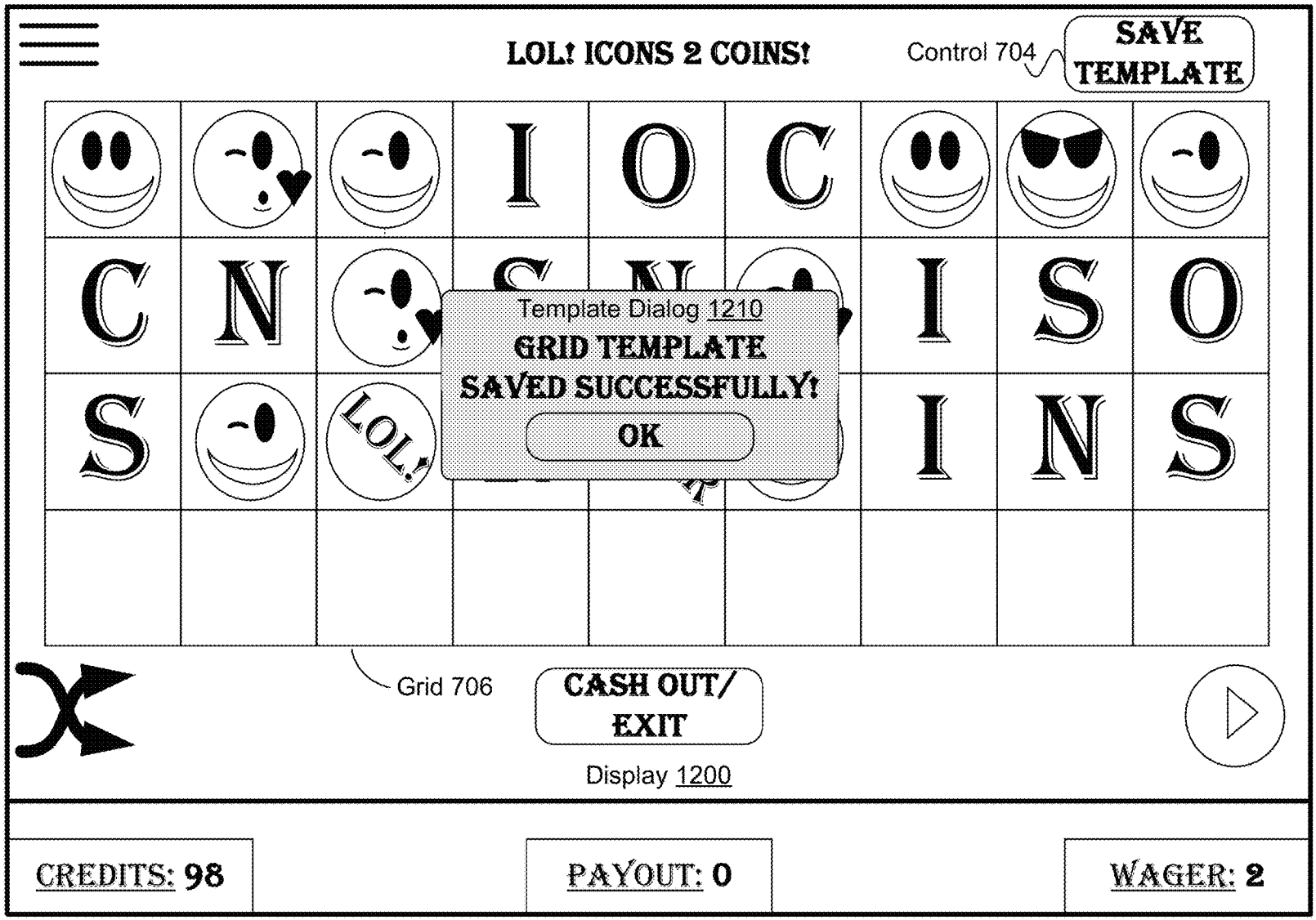

FIG. 12 depicts display 1200, which is the display of gaming device 604 after the template T640 has been saved. Display 1200 reflects events of scenario 600 that have occurred since display 1100 was provided. Display 1200 updates display 1100 by adding template dialog 1210. Template dialog 1210 informs player 602 that a "GRID TEMPLATE" (i.e., template T640) has been "SAVED SUCCESSFULLY". After providing display 1200, gaming device 604 proceeds through block 170 of set of functions 100 to arrive at block 124 of set of functions 100.

FIG. 6 shows that scenario 600 continues with player 602 using select new symbol set control 708 to provide GetNewSymbolSet message 650 as an input to gaming device 604 to select a new symbol set for the herein-described game. Gaming device 604 proceeds through blocks 130, 140, 150, 160, and 170 of set of functions 100 to arrive at block 110 to process GetNewSymbolSet message 650. At block 110 of set of functions 100, gaming device 604 determines that template T640 is available, as indicated at block 652 of FIG. 6, and proceeds to block 112 of set of functions 100. At block 112, gaming device 604 determines that NB, the number of blank symbols of template T640, equals nine, determines the nine grid positions for blank symbols recorded in template T640, and proceeds to block 120 of set of functions 100. At block 120, gaming device 604 selects a new set of symbols S for grid 706, where NR equals four and NC equals nine. As gaming device 604 has determined that NB equals nine, NNB, the number of non-blank symbols, can be determined to be (NR×NC)−NB=27 before proceeding to block 122 of set of functions 100. Gaming device 604 then uses the procedures of block 122 to update the display to show the newly-selected set of symbols in grid 706 as indicated at block 652. In scenario 600, the newly-selected symbols in grid 706 align with template T640. Specifically, grid 706 includes blank symbols at grid locations that are the grid locations for blank symbols specified in template T640.

Figure 13:
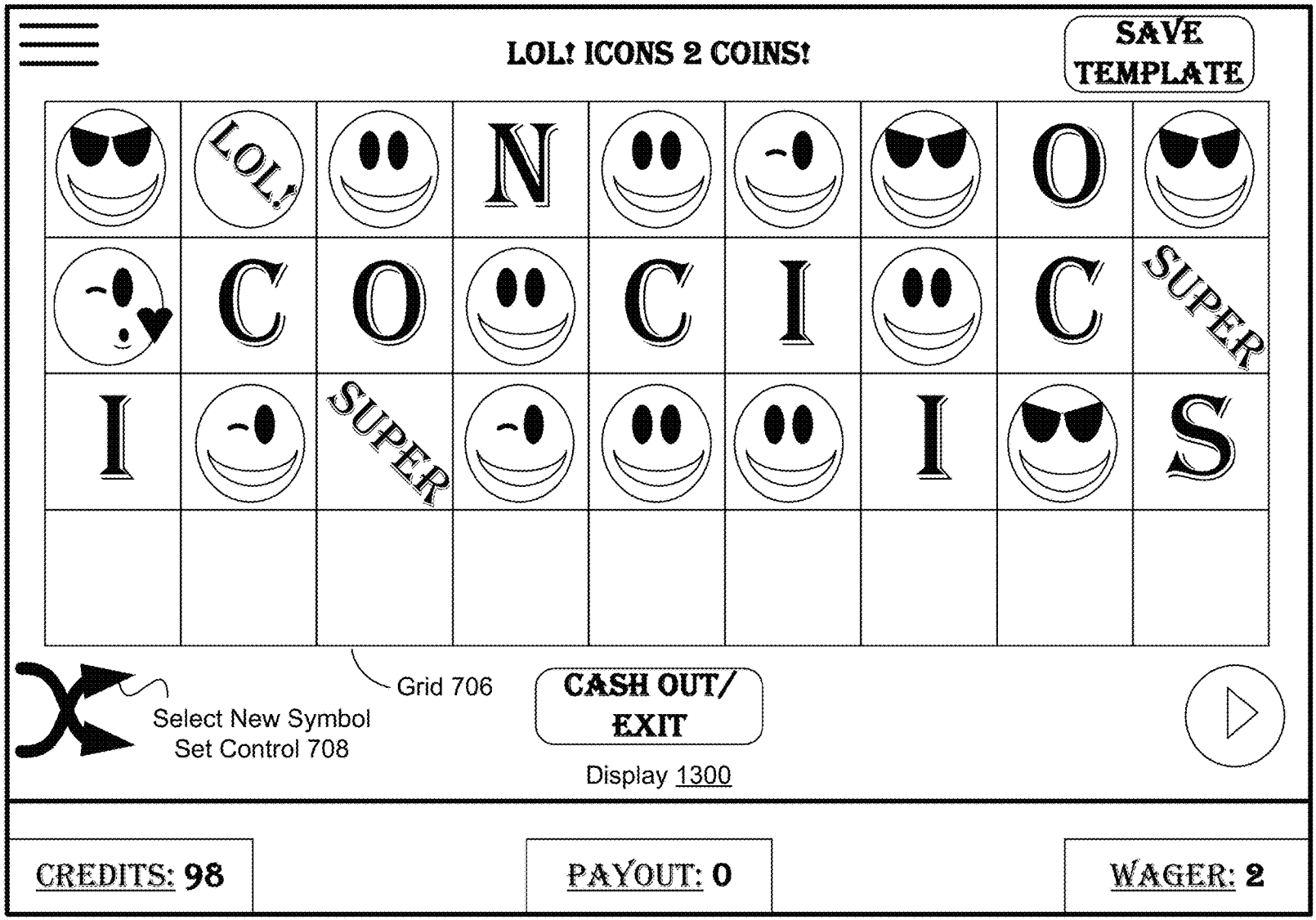

FIG. 13 depicts display 1300, which is the display of gaming device 604 after the newly-selected set of symbols have been shown. Display 1300 reflects events of scenario 600 that have occurred since display 1200 was provided. Display 1300 updates display 1200 by removing template dialog 1210 and displaying the newly-selected set of symbols in grid 706. Display 1300 also shows that the symbols displayed in grid 706 conform to template T640. In particular, display 1300 shows that rows one, two, and three of grid 706 have non-blank symbols and row four of grid 706 has non-blank symbols. FIG. 12 shows that, when template T640 was saved, rows one, two, and three of grid 706 have only non-blank symbols and row four of grid 706 has only non-blank symbols. Thus, FIG. 13 shows that grid 706 of display 1300 conforms to template T640. After providing display 1300, gaming device 604 proceeds to block 124 of set of functions 100.

FIG. 6 shows that scenario 600 continues with player 602 using wager/new turn control 712 and wager dialog 730 to provide Wager message 660 as an input to gaming device 604 to make a second wager of "2 credits" to continue playing the herein-described game. After receiving Wager message 660 as input, gaming device 604 proceeds from block 124 of set of functions 100, through blocks 130 and 140 to arrive at block 142 of set of functions 100. Block 662 shows that gaming device 604 accepts the wager of two credits and subtracts two credits from the credit balance CB of 100 credits, thereby updating the credit balance CB to be 96 credits. Gaming device 604 then proceeds to block 144 of set of functions 100 to select a number of winning symbols NW equal to 3 and selects NW (3) winning symbols as set WS for the second turn. As part of the procedures of block 144, gaming device 604 then updates the display to inform player 602 of the winning symbols.

During the second turn of scenario 600, gaming device 604 determines that the set of winning symbols WS includes a trigger symbol, as indicated at block 662 of FIG. 6. In response to selecting the trigger symbol as part of the set of winning symbols WS, gaming device 604 displays an animation that adds seven more symbols to the set of winning symbols WS for a total number of winning symbols NW of ten.

Gaming device 604 then proceeds to block 146 of set of functions 100 to determine the payout PO of the second turn. In this example, PO equals 104 credits. As part of the procedures of block 146, gaming device 604 adds payout PO to credit balance CB. At this stage of scenario 600, PO equals 104 credits and CB equals 96 credits, so CB is updated to be 200 credits at block 146. Gaming device 604 then proceeds through blocks 150, 160, and 170 of set of functions 100 to arrive at block 124. At block 124 of set of functions 100, gaming device 604 displays credit balance CB and awaits an input I.

Figure 14:
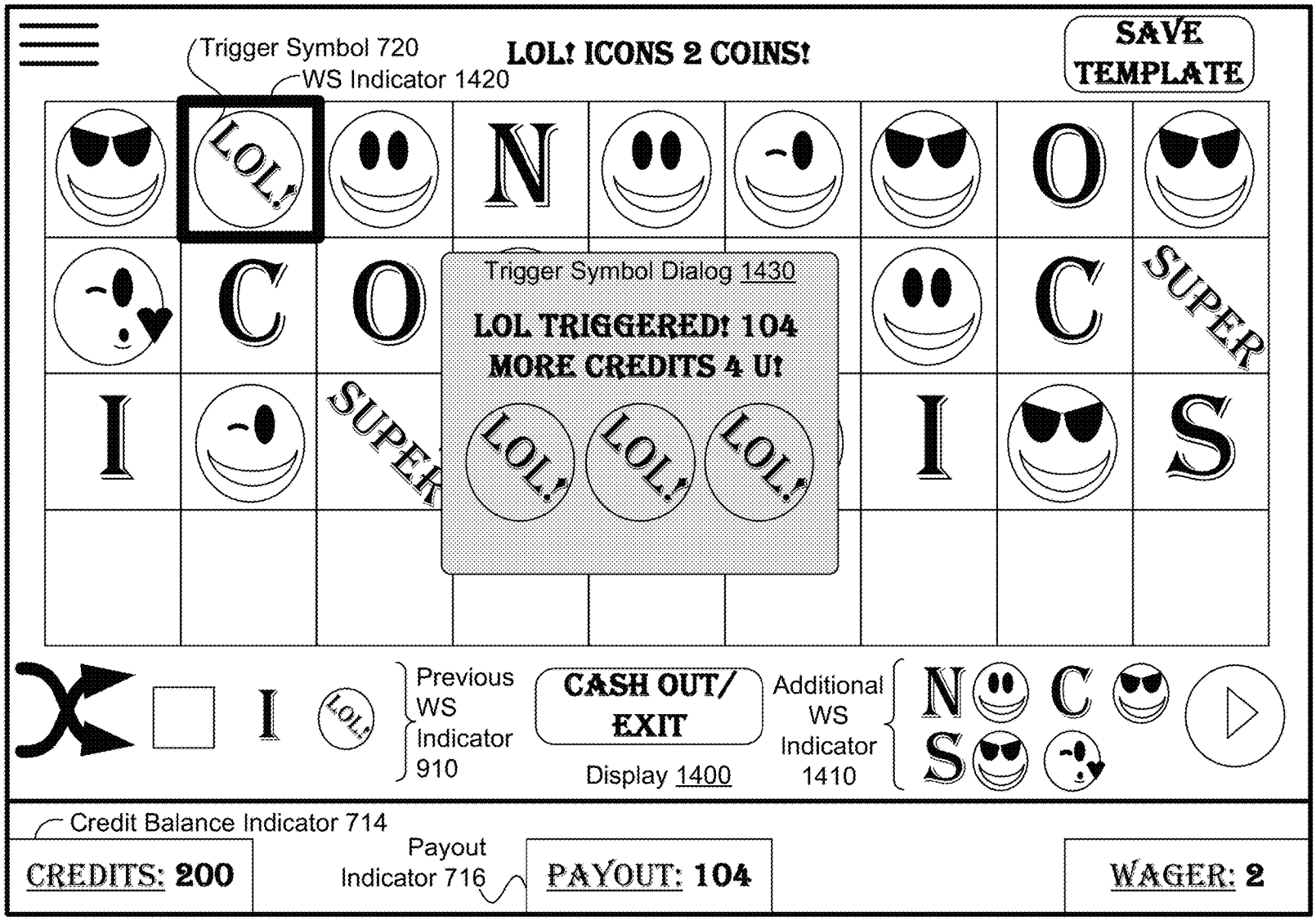

FIG. 14 depicts display 1400, which is the display of gaming device 604 after credit balance CB has been updated to account for the payout of 104 credits of the second turn of scenario 600. Display 1400 reflects events of scenario 600 that have occurred since display 1300 was provided. Display 1400 updates display 1300 by updating credit balance indicator 714 and payout indicator 716 with the results of the second turn of scenario 600 and by adding previous winning symbol indicator 910, additional winning symbol indicator 1410, winning symbol indicator 1420, and trigger symbol dialog 1430 to display 1300. As shown in FIG. 14, credit balance indicator 714 has been updated to reflect that player 602 now has "200" credits as a result of the payout of "104" credits shown in payout indicator 716.

The payout of 104 credits is due to winning symbol set WS including, as shown by previous winning symbol indicator 910, a blank symbol, an "I" symbol, and trigger symbol 720. The selection of trigger symbol 720 as a winning symbol is shown in display 1400 by winning symbol indicator 1420 surrounding trigger symbol 720 at grid location (1, 2) of grid 706.

As a result of the selection of trigger symbol 720 as a winning symbol, seven additional winning symbols are added to winning symbol set WS, as shown by additional winning symbol indicator 1410, which also contribute to the 104 credit payout of the second turn of scenario 600. Gaming device 604 also updates the display to provide an animation of the seven additional winning symbols, and separately displays the seven additional winning symbols using additional winning symbol indicator 1410.

In particular, additional winning symbol indicator 1410 shows that the seven additional winning symbols include: an "N" symbol, a smiling face symbol, a "C" symbol, a smiling face with sunglasses symbol, an "S" symbol, another smiling face with sunglasses symbol, and a whistling face symbol. Trigger symbol dialog 1430 indicates that trigger symbol 720 is a winning symbol by displaying "LOL TRIGGERED! 104 MORE CREDITS 4 U!"

FIG. 6 shows that scenario 600 continues with player 602 selecting cash out/exit control 710 to provide CashOut message 670 as an input to gaming device 604 to cash out and cease playing the herein-described game. After receiving CashOut message 670 as input, gaming device 604 proceeds from block 124 through block 130 to arrive at block 132 of set of functions 100. Block 672 shows that gaming device 604 cashes out player 602. In this example, player 602 is cashed out by gaming device 604 printing a payment ticket corresponding to 200 credits. After cashing out player 602, gaming device 604 displays a notification of the cash out.

Figure 15:
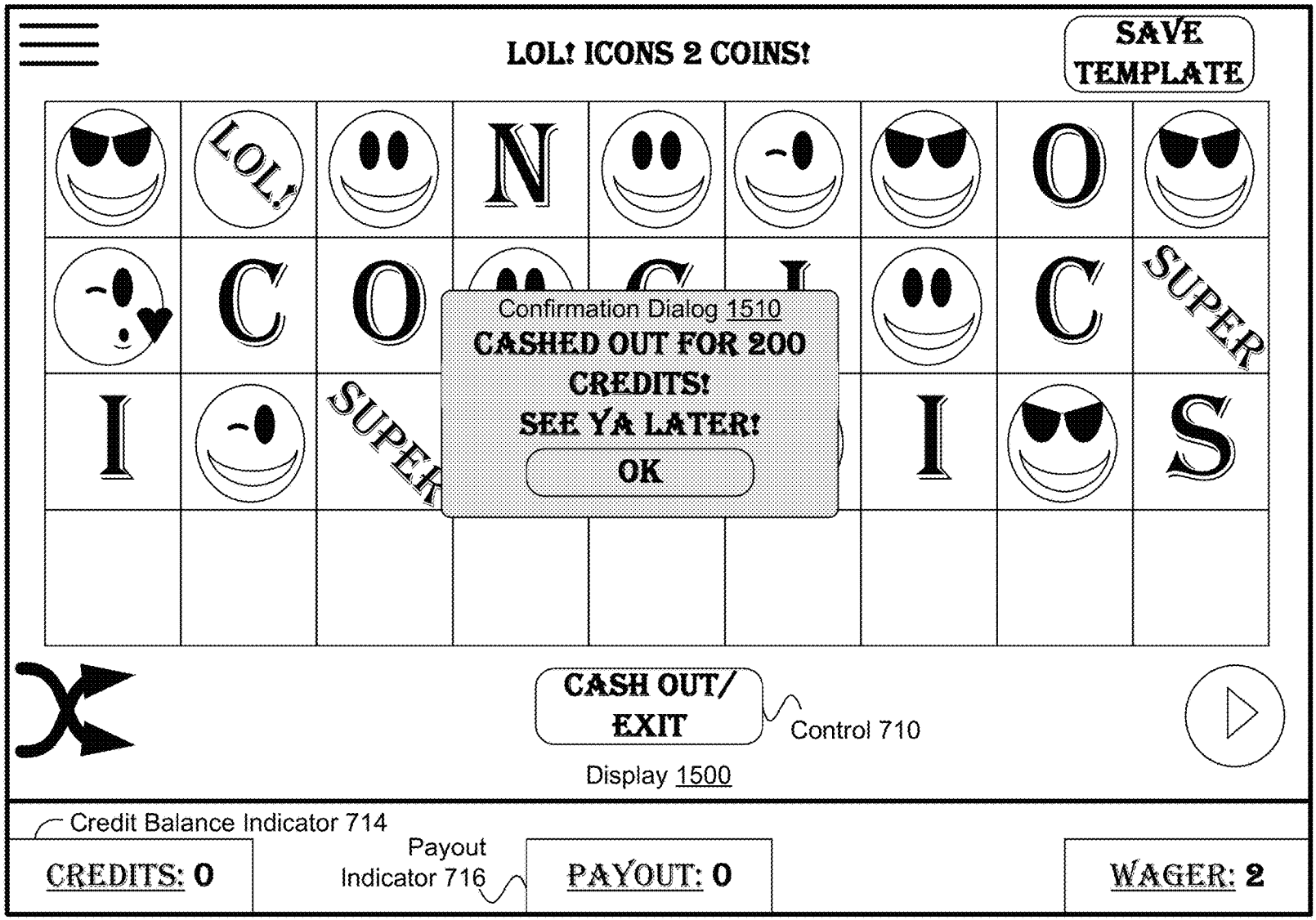

FIG. 15 depicts display 1500, which is the display of gaming device 604 after player 602 has been cashed out and the notification of the cash out of scenario 600 has been provided. Display 1500 reflects events of scenario 600 that have occurred since display 1400 was provided. Display 1500 updates display 1400 by: updating credit balance indicator 714 and payout indicator 716 after cashing out, removing previous winning symbol indicator 910, additional winning symbol indicator 1410, winning symbol indicator 1420, and trigger symbol dialog 1430, and displaying confirmation dialog 1510.

Credit balance indicator 714 is updated to reflect a "0" credit balance after cashing out, and payout indicator 716 is updated to indicate a payout of "0" credits. Confirmation dialog 1510 confirms that player 602 has "CASHED OUT FOR 200 CREDITS". In scenario 600, gaming device 604 also prints a payment ticket corresponding to 200 credits while display 1500 is being presented. After gaming device 604 provides display 1500 and prints a payment ticket corresponding to 200 credits, scenario 600 ends.

V. Example Operation

FIG. 16 is a flow chart of functions to carry out method 1600, in accordance with example embodiments. The functions are shown within blocks 1610 to 1630. The functions of method 1600 can be carried out by a computing device, such as computing device 200 described above in the context of at least FIG. 2. In some examples, the computing device can be configured as a gaming device while performing the functions of method 1600.

At block 1610, the computing device can select a first set of symbols using a computing device, the first set of symbols including first non-blank symbols and first blank symbols, where a number of the first non-blank symbols in the first set of symbols is greater than zero, and a number of the first blank symbols in the first set of symbols is greater than zero, such as discussed at least in the context of FIGS. 1 and 6-15.

At block 1620, the computing device can provide a display including a grid of the first set of symbols, such as discussed at least in the context of FIGS. 1, 4, and 6-15.

At block 1630, the computing device can play a first turn of a game using the computing device, the first turn including: after providing the display, receiving a wager; after receiving the wager, selecting one or more winning symbols of the first set of symbols; after selecting the one or more winning symbols, updating the display to indicate each of the one or more winning symbols within the grid; determining a payout of the wager based on the one or more winning symbols and the number of first blank symbols; and updating the display based on the payout of the wager, such as discussed at least in the context of FIGS. 1 and 4-15.

In some examples, the grid of the first set of symbols can have a plurality of grid positions, where the grid includes a non-blank symbol at a first particular grid position and a blank symbol at a second particular grid position; then, method 1600 can further include: receiving, at the computing device, an input to move the non-blank symbol from the first particular grid position to the second particular grid position; and after receiving the input to move the non-blank symbol, updating the display to display the grid of the first set of symbols with the non-blank symbol at the second particular grid position and with the blank symbol at the first particular grid position, such as discussed at least in the context of FIGS. 1, 6, and 11.

In some of these examples, method 1600 can further include: receiving an input to save a template of the grid; and after receiving the input to save the template of the grid, saving the template of the grid, the saved template of the grid indicating grid positions of at least the first blank symbols displayed on the display when the input to save a template of the grid was received, such as discussed at least in the context of FIGS. 1, 6, and 12. In some of these examples, method 1600 can further include: after saving the template of the grid, the computing device: selecting a second set of symbols, the second set of symbols including second non-blank symbols and second blank symbols, where a number of the second blank symbols in the second set of symbols is equal to a number of first blank symbols in the saved template of the grid; and providing a display including a grid of the second set of symbols, where the second blank symbols are displayed in the grid positions of the first blank symbols indicated in the saved template of the grid, such as discussed at least in the context of FIGS. 1, 6, and 13.

In other examples, method 1600 can further include: receiving, at the computing device, an input to select a second set of symbols; after receiving the input, selecting the second set of symbols including second blank symbols, where a number of second blank symbols in the second set of symbols is greater than zero; and updating the display to replace the first set of symbols in the grid with the second set of symbols, such as discussed at least in the context of FIGS. 1, 6, and 13. In some of these examples, the number of second blank symbols can differ from the number of first blank symbols, such as discussed at least in the context of FIG. 1. In other of these examples, the number of second blank symbols can equal the number of first blank symbols, such as discussed at least in the context of FIGS. 1, 6, and 13. In other of these examples, method 1600 can further include: after updating the display to replace the first set of symbols in the grid with the second set of symbols, the computing device receiving a second wager; after receiving the second wager, the computing device selecting one or more second winning symbols of the second set of symbols; after selecting the one or more second winning symbols, the computing device updating the display to indicate the one or more second winning symbols within the grid; determining a payout of the second wager based on the one or more second winning symbols using the computing device, where the payout is based on the one or more second winning symbols and the number of second blank symbols; and updating the display based on the payout of the second wager, such as discussed at least in the context of FIGS. 1, 6, 13, and 14.

In some examples, method 1600 can further include: after playing the first turn of the game, playing a second turn of the game using the computing device, the second turn including: redisplaying the grid of the first set of symbols; after redisplaying the grid, receiving a second wager; after receiving the second wager, selecting one or more second winning symbols of the first set of symbols; after selecting the one or more second winning symbols, updating the display to indicate each of the one or more second winning symbols within the grid; determining a payout of the second wager based on the one or more second winning symbols and the number of first blank symbols; and updating the display based on the payout of the second wager, such as discussed at least in the context of FIG. 1.

In some examples, the computing device can further includes a payment-related device, and method 1600 can further include: receiving a cash out input at the computing device; and after receiving the cash out input, generating a cash out payment using the payment-related device, such as discussed at least in the context of FIGS. 1, 6, and 15.

In some examples, the first set of symbols can include a trigger symbol, such as discussed at least in the context of FIGS. 1 and 6-15. In some of these examples, updating the display to indicate each of the one or more winning symbols within the grid can include: determining whether the one or more winning symbols includes the trigger symbol; and after determining that the one or more winning symbols includes the trigger symbol, updating the display to include one or more additional symbols, such as discussed at least in the context of FIGS. 1, 6, and 14. In other of these examples, determining the payout of the wager based on the one or more winning symbols and the number of first blank symbols can include determining the payout of the wager based on the one or more winning symbols, the number of first blank symbols, and the additional symbols, such as discussed at least in the context of FIGS. 1, 6, and 14.

In some examples, determining the payout of the wager based on the one or more winning symbols and the number of first blank symbols can include: determining a plurality of pay tables including a first pay table and a second pay table, where the first pay table is associated with a first particular number of blank symbols, where the second pay table is associated with a second particular number of blank symbols that is greater than the first particular number of blank symbols, and where the second pay table that has a larger average payout of than the first pay table; selecting a pay table from among the plurality of pay tables based on the number of first blank symbols; and determining the payout based on the winning symbols and the selected pay table, such as discussed at least in the context of FIGS. 1 and 5.

In some examples, providing the display including the grid of the first set of symbols can include animating at least one symbol in the grid of the first set of symbols, such as discussed at least in the context of FIGS. 1, 6, and 14.

VI. Additional Example Embodiments

The following clauses are offered as further description of the disclosure.

Clause 1—A method, including: selecting a first set of symbols using a computing device, the first set of symbols including first non-blank symbols and first blank symbols, where a number of the first non-blank symbols in the first set of symbols is greater than zero, and a number of the first blank symbols in the first set of symbols is greater than zero; providing a display including a grid of the first set of symbols using the computing device; and playing a first turn of a game using the computing device, the first turn including: after providing the display, receiving a wager; after receiving the wager, selecting one or more winning symbols of the first set of symbols; after selecting the one or more winning symbols, updating the display to indicate each of the one or more winning symbols within the grid; determining a payout of the wager based on the one or more winning symbols and the number of first blank symbols; and updating the display based on the payout of the wager.

Clause 2—The method of Clause 1, where the grid of the first set of symbols has a plurality of grid positions, where the grid includes a non-blank symbol at a first particular grid position and a blank symbol at a second particular grid position, and where the method further includes: receiving, at the computing device, an input to move the non-blank symbol from the first particular grid position to the second particular grid position; and after receiving the input to move the non-blank symbol, updating the display to display the grid of the first set of symbols with the non-blank symbol at the second particular grid position and with the blank symbol at the first particular grid position.

Clause 3—The method of either Clause 1 or Clause 2, where the method further includes: receiving an input to save a template of the grid; and after receiving the input to save the template of the grid, saving the template of the grid, the saved template of the grid indicating grid positions of at least the first blank symbols displayed on the display when the input to save a template of the grid was received.

Clause 4—The method of Clause 3, further including: after saving the template of the grid, the computing device: selecting a second set of symbols, the second set of symbols including second non-blank symbols and second blank symbols, where a number of the second blank symbols in the second set of symbols is equal to a number of first blank symbols in the saved template of the grid; and providing a display including a grid of the second set of symbols, where the second blank symbols are displayed in the grid positions of the first blank symbols indicated in the saved template of the grid.

Clause 5—The method of any one of Clauses 1-3, further including: receiving, at the computing device, an input to select a second set of symbols; after receiving the input, selecting the second set of symbols including second blank symbols, where a number of second blank symbols in the second set of symbols is greater than zero; and updating the display to replace the first set of symbols in the grid with the second set of symbols.

Clause 6—The method of Clause 5, where the number of second blank symbols differs from the number of first blank symbols.

Clause 7—The method of Clause 5, where the number of second blank symbols equals the number of first blank symbols.

Clause 8—The method of any one of Clauses 5-7, further including: after updating the display to replace the first set of symbols in the grid with the second set of symbols, the computing device receiving a second wager; after receiving the second wager, the computing device selecting one or more second winning symbols of the second set of symbols; after selecting the one or more second winning symbols, the computing device updating the display to indicate the one or more second winning symbols within the grid; determining a payout of the second wager based on the one or more second winning symbols using the computing device, where the payout is based on the one or more second winning symbols and the number of second blank symbols; and updating the display based on the payout of the second wager.

Clause 9—The method of any one of Clauses 1-7, further including: after playing the first turn of the game, playing a second turn of the game using the computing device, the second turn including: redisplaying the grid of the first set of symbols; after redisplaying the grid, receiving a second wager; after receiving the second wager, selecting one or more second winning symbols of the first set of symbols; after selecting the one or more second winning symbols, updating the display to indicate each of the one or more second winning symbols within the grid; determining a payout of the second wager based on the one or more second winning symbols and the number of first blank symbols; and updating the display based on the payout of the second wager.

Clause 10—The method of any one of Clauses 1-9, where the computing device further includes a payment-related device, and where the method further includes: receiving a cash out input at the computing device; and after receiving the cash out input, generating a cash out payment using the payment-related device.

Clause 11—The method of any one of Clauses 1-10, where the first set of symbols include a trigger symbol.

Clause 12—The method of Clause 11, where updating the display to indicate each of the one or more winning symbols within the grid includes: determining whether the one or more winning symbols includes the trigger symbol; and after determining that the one or more winning symbols includes the trigger symbol, updating the display to include one or more additional symbols.

Clause 13—The method of Clause 12, where determining the payout of the wager based on the one or more winning symbols and the number of first blank symbols includes determining the payout of the wager based on the one or more winning symbols, the number of first blank symbols, and the additional symbols.

Clause 14—The method of any one of Clauses 1-12, where determining the payout of the wager based on the one or more winning symbols and the number of first blank symbols includes: determining a plurality of pay tables including a first pay table and a second pay table, where the first pay table is associated with a first particular number of blank symbols, where the second pay table is associated with a second particular number of blank symbols that is greater than the first particular number of blank symbols, and where the second pay table that has a larger average payout of than the first pay table; selecting a pay table from among the plurality of pay tables based on the number of first blank symbols; and determining the payout based on the winning symbols and the selected pay table.

Clause 15—The method of any one of Clauses 1-14, where providing the display including the grid of the first set of symbols includes animating at least one symbol in the grid of the first set of symbols.

Clause 16—A computing device, including: one or more processors; and data storage configured to store at least computer-readable program instructions that, when executed by the one or more processors, cause the computing device to carry out functions including the method of any one of Clauses 1-15.

Clause 17—The computing device of Clause 16, where the data storage includes a non-transitory computer-readable medium.

Clause 18—A computer-readable medium configured to store instructions that, when executed by one or more processors of a computing device, cause the computing device to carry out functions including the method of any one of Clauses 1-15.

Clause 19—The computer-readable medium of Clause 18, where the computer-readable medium includes a non-transitory computer-readable medium.

VII. Conclusion

Example embodiments have been described above. Those skilled in the art will understand that changes and modifications can be made to the described embodiments without departing from the true scope of the described embodiments as claimed.

Throughout this description, the articles "a" or "an" are used to introduce elements of the example embodiments. Any reference to "a" or "an" refers to "at least one," and any reference to "the" refers to "the at least one," unless otherwise specified, or unless the context clearly dictates otherwise. The intent of using the conjunction "or" within a described list of at least two terms is to indicate any of the listed terms or any combination of the listed terms.

The use of ordinal numbers such as "first," "second," "third" and so on is to distinguish respective elements rather than to denote a particular order of those elements. For purpose of this description, the terms "multiple" and "a plurality of" refer to "two or more" or "more than one."

Further, unless context suggests otherwise, the features illustrated in each of the figures may be used in combination with one another. Thus, the figures should be generally viewed as component aspects of one or more overall embodiments, with the understanding that not all illustrated features are necessary for each embodiment.

This detailed description describes various features and functions of the disclosed systems, devices, and methods with reference to the accompanying figures. In the figures, similar symbols typically identify similar components, unless context dictates otherwise. The illustrative embodiments described in the detailed description, figures, and claims are not meant to be limiting. Other embodiments can be used, and other changes can be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

With respect to any or all of the message flow diagrams, scenarios, and flow charts in the figures and as discussed herein, each step, block and/or communication can represent a processing of information and/or a transmission of information in accordance with example embodiments. Alternative embodiments are included within the scope of these example embodiments. In these alternative embodiments, for example, functions described as steps, blocks, transmissions, communications, requests, responses, and/or messages can be executed out of order from that shown or discussed, including in substantially concurrent or in reverse order, depending on the functionality involved. Further, more or fewer steps, blocks and/or functions can be used with any of the message flow diagrams, scenarios, and flow charts discussed herein, and these message flow diagrams, scenarios, and flow charts can be combined with one another, in part or in whole.

A step or block that represents a processing of information can correspond to circuitry that can be configured to perform the specific logical functions of a herein-described method or technique. Alternatively or additionally, a step or block that represents a processing of information can correspond to a module, a segment, or a portion of program code (including related data). The program code can include one or more instructions executable by a processor for implementing specific logical functions or actions in the method or technique. The program code and/or related data can be stored on any type of computer-readable medium such as a storage device including a disk or hard drive or other storage media.

The computer-readable medium can include non-transitory computer-readable media such as computer-readable media that stores data for short periods of time like register memory, processor cache, and/or random access memory (RAM). The computer-readable media can include non-transitory computer-readable media that stores program code and/or data for longer periods of time, such as secondary or persistent long term storage, like read only memory (ROM), optical or magnetic disks, and/or compact-disc read only memory (CD-ROM), for example. The computer-readable media can be any other volatile or non-volatile storage systems. A computer-readable medium can be considered a computer-readable storage medium, for example, or a tangible storage device.

Software for use in carrying out the herein-described embodiments can also be in transitory form, for example in the form of signals transmitted over a network such as the Internet. Moreover, a step or block that represents one or more information transmissions can correspond to information transmissions between software and/or hardware modules in the same physical device. However, other information transmissions can be between software modules and/or hardware modules in different physical devices.

While various aspects and embodiments have been disclosed herein, other aspects and embodiments will be apparent to those skilled in the art. The various aspects and embodiments disclosed herein are for purposes of illustration and are not intended to be limiting.

The invention claimed is:

1. A method of operating a gaming device, the method comprising:

in response to determining that the gaming device is operating in a non-user-template mode:

selecting a first set of symbols including first non-blank symbols and first blank symbols providing, on a display device, a first display comprising the first set of symbols arranged in a grid; and selecting a first group of winning symbols from the first set of symbols;

receiving input, via a user interface, indicating a template that defines locations of blank symbols and non-blank symbols within the grid; and in response to determining that the gaming device is operating in a user-template mode based on receiving the input:

selecting a second set of symbols including second non-blank symbols and second blank symbols;

providing, on the display device, a second display comprising the second set of symbols arranged in the grid according to the template; and selecting a second group of winning symbols from the second set of symbols.

2. The method of claim 1, wherein the grid includes a non-blank symbol at a first position in the grid in the first display and a blank symbol at a second position in the grid in the first display, and wherein the method further comprises:

determining that the input comprises a request to move the non-blank symbol from the first position to the second position; and updating the first display on the display such that the non-blank symbol is at the second position and the blank symbol is at the first position.

3. The method of claim 1, wherein the method further comprises:

in response to receiving the input saving the template.

4. The method of claim 1, wherein a number of the second blank symbols differs from a number of the first blank symbols.

5. The method of claim 1, wherein a number of the second blank symbols equals a number of the first blank symbols.

6. The method of claim 1, wherein the method further comprises:

receiving a cash out input via the user interface; and after receiving the cash out input, generating a cash out payment.

7. The method of claim 1, wherein providing the first display comprises animating at least one symbol of the first set of symbols.

8. The method of claim 1, wherein the method further comprises:

determining that the input indicates a after selecting the first group of winning symbols, updating the first display to indicate the first group of winning symbols within the grid;

determining a payout of the wager based on the first group of winning symbols and a number of the first blank symbols within the first group of winning symbols; and updating the first display based on the payout of the wager.

9. The method of claim 8, further comprising:

after providing the second display, receiving a second input via the user interface, wherein the second input indicates a second wager;

after selecting the second group of winning symbols, updating the second display to indicate the second group of winning symbols within the grid;

determining a second payout of the second wager based on the second group of winning symbols and a number of the second blank symbols within the second group of winning symbols; and updating the second display based on the second payout of the second wager.

10. The method of claim 8, the method further comprising:

determining that the first group of winning symbols includes a trigger symbol; and after determining that the first group of winning symbols includes the trigger symbol, updating the first display to include one or more additional symbols.

11. The method of claim 10, wherein determining the payout of the wager based on the first group of winning symbols and the number of the first blank symbols within the first group of winning symbols comprises determining the payout of the wager based on the first group of winning symbols, the number of the first blank symbols within the first group of winning symbols, and the additional symbols.

12. The method of claim 8, wherein determining the payout of the wager based on the first group of winning symbols and the number of the first blank symbols within the first group of winning symbols comprises:

determining a plurality of pay tables comprising a first pay table and a second pay table, wherein the first pay table is associated with a first particular number of blank symbols, wherein the second pay table is associated with a second particular number of blank symbols that is greater than the first particular number of blank symbols, and wherein the second pay table that has a larger average payout of than the first pay table;

selecting a pay table from among the plurality of pay tables based on the number of first blank symbols within the first group of winning symbols; and determining the payout based on the first group of winning symbols and the selected pay table.

13. A gaming device, comprising:

a display device;

a user interface;

one or more processors; and one or more non-transitory computer-readable media storing instructions that, when executed by the one or more processors, cause the gaming device to carry out functions comprising:

in response to determining that the gaming device is operating in a non-user-template mode:

selecting a first set of symbols, including first non-blank symbols and first blank symbols, providing, on the display device, a first display comprising the first set of symbols arranged in a grid; and selecting a first group of winning symbols from the first set of symbols;

receiving input, via the user interface, indicating a template that defines locations of blank symbols and non-blank symbols within the grid; and in response to determining that the gaming device is operating in a user-template mode based on receiving the input:

selecting a second set of symbols including second non-blank symbols and second blank symbols;

providing, on the display device, a second display comprising the second set of symbols arranged in the grid according to the template; and selecting a second group of winning symbols from the second set of symbols.

14. The gaming device of claim 13, wherein the grid includes a non-blank symbol at a first position in the grid in the first display and a blank symbol at a second position in the grid in the first display, wherein the functions further comprise: determining that the input comprises a request to move the non-blank symbol from the first position to the second position; and updating the first display such that the non-blank symbol is at the second position and the blank symbol is at the first position.

15. The gaming device of claim 13, wherein a number of the second blank symbols is equal to a number of blank symbols indicated by the template.

16. The gaming device of claim 13, wherein the functions further comprise:

determining that the input indicates a wager;

after selecting the first group of winning symbols, updating the first display to indicate the first group of winning symbols within the grid;

determining a payout of the wager based on the first group of winning symbols and a number of the first blank symbols within the first group of winning symbols; and updating the first display based on the payout of the wager.

17. A non-transitory computer-readable medium storing instructions that, when executed by one or more processors of a gaming device, cause the gaming device to carry out functions comprising:

in response to determining that the gaming device is operating in a non-user-template mode:

selecting a first set of symbols including first non-blank symbols and first blank symbols providing, on a display device, a first display comprising a grid of the first set of symbols arranged in a grid; and selecting a first group of winning symbols from the first set of symbols;

receiving input, via a user interface, indicating a template that defines locations of blank symbols and non-blank symbols within the grid; and in response to determining that the gaming device is operating in a user-template mode based on receiving the input:

selecting a second set of symbols including second non-blank symbols and second blank symbols;

providing, on the display device, a second display comprising the second set of symbols arranged in the grid according to the template; and selecting a second group of winning symbols from the second set of symbols.

18. The non-transitory computer-readable medium of claim 17, wherein the functions further comprise:

determining that the input indicates a wager;

after selecting the first group of winning symbols, updating the first display to indicate the first group of winning symbols within the grid;

determining a payout of the wager based on the first group of winning symbols and a number of the first blank symbols within the first group of winning symbols; and updating the first display based on the payout of the wager.

* * * * *